US010302261B2

(12) United States Patent
Wu

(10) Patent No.: US 10,302,261 B2
(45) Date of Patent: May 28, 2019

(54) AUTOMATIC INSTALLATION MECHANISM, LAMP HAVING AUTOMATIC INSTALLATION MECHANISM, AND INSTALLATION METHOD THEREOF

(71) Applicant: Liangju Wu, Foshan (CN)

(72) Inventor: Liangju Wu, Foshan (CN)

( * ) Notice: Subject to any disclaimer, the term of this patent is extended or adjusted under 35 U.S.C. 154(b) by 111 days.

(21) Appl. No.: 15/108,571

(22) PCT Filed: Oct. 24, 2014

(86) PCT No.: PCT/CN2014/089391
§ 371 (c)(1),
(2) Date: Jun. 27, 2016

(87) PCT Pub. No.: WO2015/058707
PCT Pub. Date: Apr. 30, 2015

(65) Prior Publication Data

US 2017/0198870 A1 Jul. 13, 2017

(30) Foreign Application Priority Data

Oct. 26, 2013 (CN) ..... 2013 1 0535927
Mar. 29, 2014 (CN) ..... 2014 2 0170281 U
Nov. 25, 2015 (EG) ..... 14856359

(51) Int. Cl.
*A47F 5/00* (2006.01)
*F21S 8/02* (2006.01)
*F21V 21/04* (2006.01)
*F21V 29/76* (2015.01)
*F21V 17/16* (2006.01)
*F21V 21/108* (2006.01)

(52) U.S. Cl.
CPC ..... *F21S 8/026* (2013.01); *F21V 17/166* (2013.01); *F21V 21/046* (2013.01); *F21V 21/108* (2013.01); *F21V 29/767* (2015.01)

(58) Field of Classification Search
CPC ..... F21V 17/66; G07G 3/3413; F21S 8/04; F21S 8/026
See application file for complete search history.

(56) References Cited

U.S. PATENT DOCUMENTS 4,763,231 A * 8/1988 Houplain ..... F21V 19/0005 362/148
7,281,697 B2 * 10/2007 Reggiani ..... F21V 21/04 248/221.11
2015/0085499 A1 * 3/2015 Mandy ..... F21V 21/046 362/365

* cited by examiner

*Primary Examiner* — Amy J. Sterling
(74) *Attorney, Agent, or Firm* — Raymond Y. Chan; David and Raymond Patent Firm

(57) ABSTRACT

An automatic lamp installation mechanism includes a support element having one end of rotatably connected to a side of a fixing base; an elastic element arranged between the support element and the fixing base, a fixing element provided on the support element and including a first catch element; and a limiting element provided on the side of the fixing base and having a triggering element and a second catch element, wherein the triggering element is located apart from the fixing base.

20 Claims, 28 Drawing Sheets

AUTOMATIC INSTALLATION MECHANISM, LAMP HAVING AUTOMATIC INSTALLATION MECHANISM, AND INSTALLATION METHOD THEREOF

CROSS REFERENCE OF RELATED APPLICATION

This is a non-provisional application that claims priority to international application number PCT/CN2014/089391, international filing date Oct. 24, 2014, the entire contents of each of which are expressly incorporated herein by reference.

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to an installation mechanism and more particularly to an automatic installation mechanism and an automatic installation lamp, wherein an object being installed, such as a lamp, can achieve the automatic installation, is easy to be installed, and have high efficiency.

Description of Related Arts

Lamps are the most common illumination appliances in our daily life. During the installation of the lamps, such as ceiling lamps, an installation hole is needed to allow the ceiling lights being mounted therein in order to provide an indoor illumination.

As shown in FIG. 1, the installation mechanism for the conventional ceiling light comprises a fixing member 100, a torsion spring 200, a U-shaped strut 300, wherein the fixing member 100 is installed on a shell body 400 of the ceiling light, and the torsion spring 200 is coupled on the fixing member 100 to connect with one side of the fixing member 100 and one side of the U-shaped strut 300 respectively, so that the torsion spring 200, which is connected with one side of the U-shaped strut 300, is a rotation shaft adapted to rotate towards an lower portion of the fixing member 100 in order to reach the shell body 400. In order to ensure the stability for the installation of the ceiling light, two sets of the installation mechanism for the conventional ceiling light are adapted to symmetrically install on the shell body 400 of the ceiling light, and the U-shaped strut 300 is arranged on an outer side of the fixing member 100.

Accordingly, while the ceiling light is installed on the ceiling via the above mentioned installation mechanism, an action force is applied on the U-shaped strut 300 to force the U-shaped strut 300 overcome a torsion provided by the torsion spring 200, so that the torsion spring 200 is a rotation shaft to force one side of the U-shaped strut 300 to rotate towards the top portion of the fixing member 100 until that the U-shaped strut 300 is in a vertical position, and then the action force is continuously applied on the U-shaped strut 300 as well as that the ceiling light is placed into an installation hole of the ceiling. At the same time, at least a partial of one side of the U-shaped strut 300 is passed through the ceiling, and then the action force is released. After that, one side of the U-shaped strut 300, which is connected with the torsion spring 200, starts to reset until that one side of the U-shaped strut 300 touches the margin edge of the installation hole of the ceiling. If a lower portion of the shell body 400 of the ceiling light has a protrude edge (as shown in FIG. 1). The ceiling is seized between the protrude edge of the shell body 400 and the U-shaped strut 300.

Therefore, according to the above mentioned installation process, the action force is needed to applied on the U-shaped strut 300 to overcome the torsion provided by the torsion spring 200, so that the U-shaped strut 300 can be prevented to rotate towards the lower portion of the shell body 400 through the torsion of the torsion spring 200 as well as that the torsion spring 200 is a rotation shaft, and otherwise, the ceiling light cannot be installed. The action force applied on the U-shaped strut 300 is exerted by the installation officers, wherein it is very difficult to remain the action force on the U-shaped strut 300 by only one hand of the installation officers. In addition, while the ceiling light is large in size and has multiple U-shaped struts 300, it is still very difficult to remain the action force on the U-shaped struts 300 by two hands of the installation officers. The action force is applied on an action point, wherein while the action point is located on a location more closely to the torsion spring 200, the action force applied on the U-shaped strut 300 is relatively larger, and in the other words, while the action point is located on a location away from the torsion spring 200, which is more closely to the other side of the U-shaped strut 300, the action force applied on the U-shaped strut 300 is relatively smaller. However, the size of the installation hole is not much larger than that of the shell body 400, so that the existence of the hands may impede the installation of the ceiling light, and more especially the action force is applied on the location more closely to the other side of the U-shaped strut 300, the installation of the ceiling light is more difficult. Therefore, the installation of the conventional ceiling light is inconvenient, energy-wasting, and low in efficiency. And, while the ceiling light needs to be detached from the ceiling, the hands of the installation offices will be damaged by the rebound of the torsion spring 200, so that the installation of the conventional ceiling light is unsafety.

The lights are the most common illumination appliance in our daily life. In order to incorporate the interior design and the illumination angle of the lights, there are multiple methods for installing the lights, but the most common method to install the lights for the normal family is the embedded method, such that the lights is embedded inside the installation hole of the ceiling to provide the illumination function.

The installation method for the conventional lights is to install the lights by hands, and in such manner, the installation time and steps is increased, and at the same time, supplemental tools may be needed to complete the installation process, and further increase the probability of the injure for the installation officers. Especially while the lights are broken in the late night, the users feel hassle to replace the lights by themselves due to the dark environment and the complicated installation steps for the convention lights.

The conventional installation for the lights is to use the awkward springs to complete the installation process, wherein during the installation process, two hands of the user is needed to be apply the action force to overcome the torsion of the torsion springs, and the action force is applied to counter the torsion, and then the light is placed into the installation hole of the ceiling to complete the installation of the light. During the installation process, a large amount of action force is needed to be applied on the torsion spring by two hands of the user, so as to increase the labor intensity and the risk of accidents.

Therefore, the mounting structure of the present invention is improved comparing with the original mounting structure, so that the improved mounting structure of the present invention is easy and convenient to operate. An automatic switch based on a simple cam is adapted to achieve the automatic installation and detachment as well as to efficiently decrease the manufacturing cost.

The present invention is to provide the automatic switch based on a simple mechanical principle, wherein the automatic switch is used to replace the human hands. During the installation of the lights, the torsion spring is pulled up by the human hands and is locked by the automatic switch, and then the lights can be installed on the ceiling. While the lights need to be installed or detached, the automatic switch is activated to install or detach the lights through that the automatic switch and the inner wall of the installation hole of the ceiling is contacted with the automatic switch, so as to achieve the automatic installation and detachment process.

SUMMARY OF THE PRESENT INVENTION

The invention is advantageous in that it provides an automatic installation mechanism with simple in structure and low in manufacturing cost.

Another advantage of the invention is to provide an automatic installation mechanism, wherein the automatic installation mechanism can be installed on an object, such as ceiling lamps, so as to achieve an automatic installation object with easy to installation function.

Another advantage of the invention is to provide an automatic installation mechanism, wherein the automatic installation mechanism can be installation on an object, such as ceiling lamps, so as to achieve an automatic installation object, reduce the labor loads for the installation officers, and improve the installation efficiency.

Another advantage of the invention is to provide an automatic installation lamp, wherein the automatic installation lamp can be installed automatically and conveniently.

Another advantage of the invention is to provide an automatic installation lamp, wherein the automatic installation lamp can be installed automatically, and further reduces the labor loads for the installation officers, and improve the installation efficiency.

Another advantage of the invention is to provide an automatic installation device, wherein an automatic switch is provided to achieve the automatic installation, so that the user can easily install and replace the automatic installation lamp.

Another advantage of the invention is to provide an automatic installation device, wherein the automatic installation device can be installed on the automatic installation lamp, so as to allow the automatic installation lamp being more easily to install on the ceiling.

Another advantage of the invention is to provide an automatic installation device, wherein a simple elliptic mechanism is able to simply the installation procedure as well as to efficiently lower the manufacturing cost.

Another advantage of the invention is to provide an automatic installation device, wherein the installation method for the automatic installation lamp is simplified, so that the user is easy to install the automatic installation lamp by himself/herself, so as to prevent the waste of manpower.

Another advantage of the invention is to provide an automatic installation device, wherein the lock unit comprises a locking portion to ensure the stability of the installation method for the automatic installation lamp.

Another advantage of the invention is to provide an automatic installation device, wherein no additional manufacturing cost for the automatic installation lamp will be generated, and the installation method for the automatic installation lamp is simplified, so as to achieve the automatic installation procedure.

Another advantage of the invention is to provide an automatic installation device, wherein the automatic switch is adapted to operate the automatic installation method, so that the automatic switch is activated by touching with the ceiling, so that the user doesn't need to apply too much effort to detach or install the automatic installation lamp on the ceiling.

Additional advantages and features of the invention will become apparent from the description which follows, and may be realized by means of the instrumentalities and combinations particular point out in the appended claims.

According to the present invention, the foregoing and other objects and advantages are attained by an automatic installation mechanism, comprising:

an elastic element;

a fixing base;

a support element having one end rotatably connected with the side face of the fixing base, wherein the elastic element is arranged between the support element and the fixing base to connect the support element and the fixing base respectively, wherein the free end of the support element is adapted to pivotally move towards a lower portion of the fixing base;

a fixing element having a first catch element; and a limiting element having a triggering element and a second catch element, wherein triggering element is activated to move away from the fixing base, and the fixing element is arranged on the support element, and the limiting element is movably or rotatably arranged on the side face of the fixing base, and the fixing element is arranged on an upper portion of the fixing base, and the limiting element is movably or rotatably arranged on the support element, wherein the free end of the support element is able to overcome a torsion provided by the elastic element, so that the free end of the support element pivotally moves towards the upper portion of the fixing base as well as that the second catch element is hooked on the first catch element, and while the triggering element is activated to support the limiting element being moved down or pivotally moved along the support element, the second catch element is detached from the first catch element.

Accordingly, the first catch element is a fixing plate, and the second catch element is a baffle, wherein the free end of the support element is pivotally moved towards the upper portion of the fixing base by overcoming the torsion of the elastic element, the baffle is hooked on the fixing plate so as to achieve that the second catch element is hooked on the first catch element. While the triggering element is activated to force the limiting element being moved or sliding down along the support element, the baffle is moved down or pivotally moved to detach from the fixing plate, so as to achieve that the second catch element is detached from the first catch element.

Accordingly, the baffle is a wedge-shaped baffle, wherein the wedge-shaped baffle has an inclined surface facing away from the fixing base.

Accordingly, the number of the first and second catch element is one, and the first and second catch elements are able to hook with each other.

Accordingly, the limiting element is slidably or rotatably arranged on the side face of the fixing base, and the automatic installation mechanism further comprises an elastic resetting element erectly arranged between the limiting element and the fixing base, and the elastic resetting element is biased against the limiting element and the fixing base.

Accordingly, the elastic resetting element can be a spring or a helicoid spring, wherein the helicoid spring or spring are erectly arranged between a bottom portion of the limiting element and the fixing base, and are biased against the lower end of the limiting element and the fixing base.

Accordingly, the elastic resetting element can be a spring or a helicoid spring, wherein the helicoid spring or spring are erectly arranged inside the limiting element and arranged between the limiting element and the fixing base, and are biased against the lower end of the limiting element and the fixing base.

Accordingly, the limiting element is slidably or rotatably arranged on the side face of the fixing base, and the automatic installation mechanism further comprises an elastic resetting element is arranged inside the limiting element, and arranged between the limiting element and the fixing base, and the elastic resetting element is biased against the limiting element and the fixing base.

Accordingly, the elastic resetting element can be a helicoid spring,

Accordingly, the side surface of the fixing base comprises a box body, wherein the limiting element is slidably or rotatably arranged on the box body, and the limiting element is able to slide up-and-down along the box body. A triggering element is arranged through a side face of the box body, and the triggering element is exposed to the side face of the box body, and is able to be slide up-and-down along the box body. The second catch element is arranged through the top portion of the box body and exposed to outside.

Accordingly, two sides of the box body comprises two symmetrically arranged guiding grooves, and two sides of the limiting element comprises two symmetrically arranged guiding shafts, wherein the guiding shafts are arranged inside the guiding grooves.

Accordingly, the guiding grooves are L-shaped guiding grooves.

Accordingly, the first catch element is a fixing groove having an opening facing towards one end of the support element, and the second catch element is a baffle, wherein the free end of the support element is adapted to overcome the action force provided by the elastic element and is pivotally moved towards the upper portion of the fixing base. The baffle is deposed inside the fixing groove and is hooked into the fixing groove, wherein the fixing groove is formed close to the side face of the fixing base, so as to achieve that the fixing groove being hooked into the first catch element. While the triggering element is activated by the action force to force the limiting element being pivotally moved or slide downward, the baffle is moved downwardly or rotated to detach from the fixing groove, so that the second catch element being detached from the first catch element.

Accordingly, the elastic element is rotatably connected with the side face of the fixing base, and is connected with the one end of the support element and the fixing base respectively. In other words, the one end of the support element is rotatably connected to the side face of the fixing base.

Accordingly, the elastic element is a hollow structure, wherein the side face of the fixing base comprises a pair of symmetrically arranged protruded portions, and two ends of the elastic element are coupled on the two protruded portions, so as to achieve that the elastic element is rotatably linked on the side face of the fixing base.

Accordingly, the elastic element and the support element are formed as a whole.

Accordingly, the elastic element is a helicoid spring.

Accordingly, the support element is a U-shaped support element, wherein two free ends of the U-shaped support element are connected to the elastic element, and two ends of the fixing element are arranged on the support element.

Accordingly, the two ends of the fixing element comprises two coupling grooves, wherein an opening of the coupling groove is smaller than the inner portion of the coupling groove, so that two legs of the U-shaped support element are coupled inside the coupling groove through the opening.

Accordingly, the triggering element is a sheet-shaped element.

In accordance with another aspect of the invention, the present invention comprises an automatic installation lamp, wherein the automatic installation lamp comprises;

a shell body; and at least one automatic installation mechanism; wherein a fixing base is installed on a side face of the shell body, and a support element is exposed outside.

Accordingly, the number of the automatic installation mechanism is 2 or 4, and the automatic installation mechanisms are symmetrically arranged.

In accordance with another aspect of the invention, the present invention comprises an installation method for the automatic installation lamp comprises the following steps:

1. Prevent the free end of the support element being pivotally moved towards the lower portion of the fixing base, and the support element is remained at the first position;

2. Remove the second catch element, and the second catch element is not stopped by the first catch element of the support element;

3. Pivotally move the support element, and the free end of the support element is rotated towards the upper portion of the fixing base;

4. Lift up the fixing base, and force the lower portion of the fixing base being contacted with the ceiling, so as to fix the automatic installation lamp on the ceiling.

It is worth mentioning that before the step 1 of the installation method for the automatic installation lamp, the installation method further comprises a step A: pivotally move the free end of the support element to reach the first position.

It is worth mentioning that the installation method for the automatic installation lamp 1 further comprises a step 5 after the step 4: Remove the second catch element, and the restoring force provided by the elastic resetting element is exerted on the triggering element to force the triggering element moving towards the guiding groove, so that the second catch element return to hook on the first catch element.

The step 1 further comprises the following steps:

(1.1) A restoring force is applied on the support element by the elastic element to force the free end of the support element being pivotally moved to the upper portion of the fixing base.

(1.2) The second catch element is adapted to lock with the first catch element, so as to stop the free end of the support element being pivotally moved towards the upper portion of the fixing base, so as to maintain the support element in the first position.

The step 2 further comprises the following steps that:

(2.1) An external force is exerted to the limiting element to overcome the torsion exerted on the limiting element by the elastic resetting element, so as to drive the first catch element being un-blocked by the second catch element.

(2.2) The guiding shafts of the limiting element is driven to move towards the guiding grooves, so that the triggering element is guided to move away from the first catch element, and then the second catch element is detached from the first catch element.

(2.3) The external force is exerted on the triggering element, so that the limiting element is able to overcome the action force provided by the elastic resetting element. The triggering element is activated to move the limiting element, and the first catch element of the limiting element is moved to un-blocked by the second catch element, so as to release the first catch element.

The step 3 further comprises the following step that:

(3.1) The elastic element is able to provide a restoring force.

(3.2) The free end of the support element is pivotally moved towards the portion of the fixing base by the restoring force provided by the elastic element.

The step 4 further comprises the following steps that:

(4.1) The free end of the support element is blocked for rotating towards the lower portion of the fixing base as well as that the support element being touched with the ceiling (4.2) The restoring force provided by the elastic element is exerted on the free end of the support element to rise up the fixing base.

(4.3) The automatic installation lamp is fixed on the ceiling, and the fixing base of the automatic installation lamp is raised up to abut the ceiling, so as to fix the automatic installation lamp.

In accordance with another aspect of the invention, the present invention comprises an automatic installation mechanism device, comprising:

a shell body having a flat and circle shaped base, two protruded fixing plats, and a ring-shaped fixing wall arranged between two fixing plate;

an automatic switch having a cover, an operation cavity, a trigger arm having an elliptic cam, a moving block, and an elastic element arranged under the moving block, wherein the elliptic cam is adapted to drive the moving block being operated up-and-down, and the elastic element can support the moving block; and two lock units made of elastic metal, wherein the lock unit comprises an elastic portion, a pair of supporting arm outwardly extended from the elastic portion, a bending portion inwardly extended from a center portion of the supporting arm, a locking portion arranged adjacent to the bending portion, and a fixing portion adapted to connect the two supporting arms to form an enclose structure.

While the trigger arm of the automatic switch is rotated, the moving block will be activated to operate an up-and-down liner operation, so that the moving block is adapted to lock or unlock by the locking portion, so as to achieve the automatic installation purpose.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
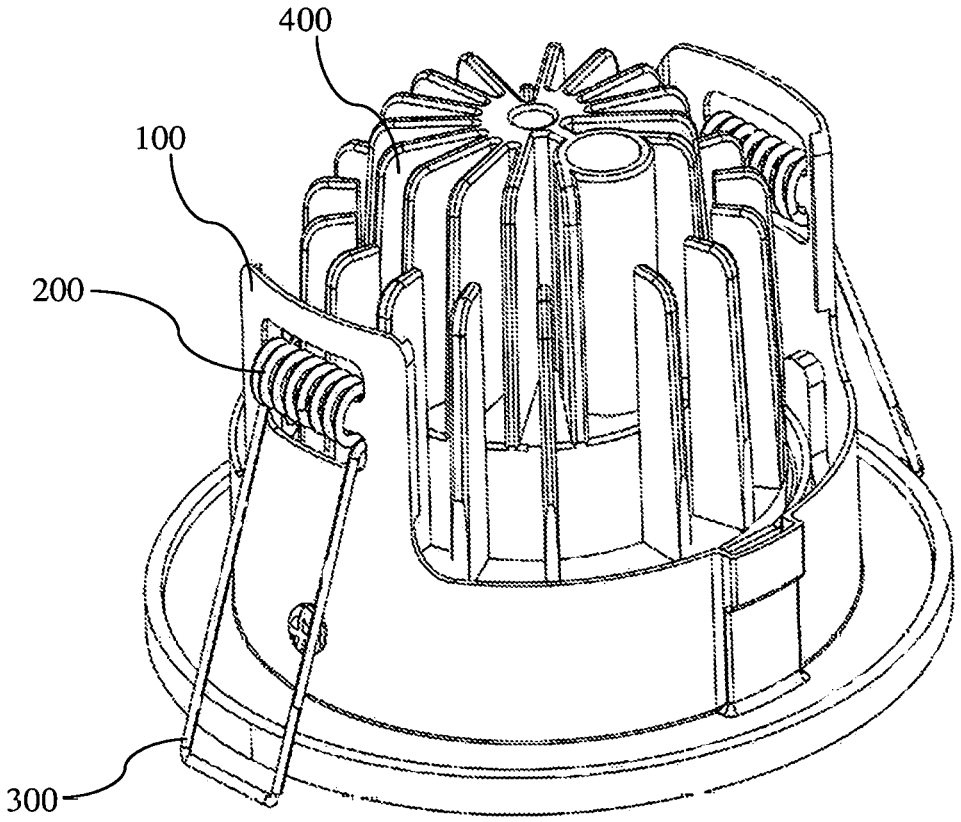
FIG. 1 is a perspective view of a current automatic installation lamp according to a prior art.
Figure 2:
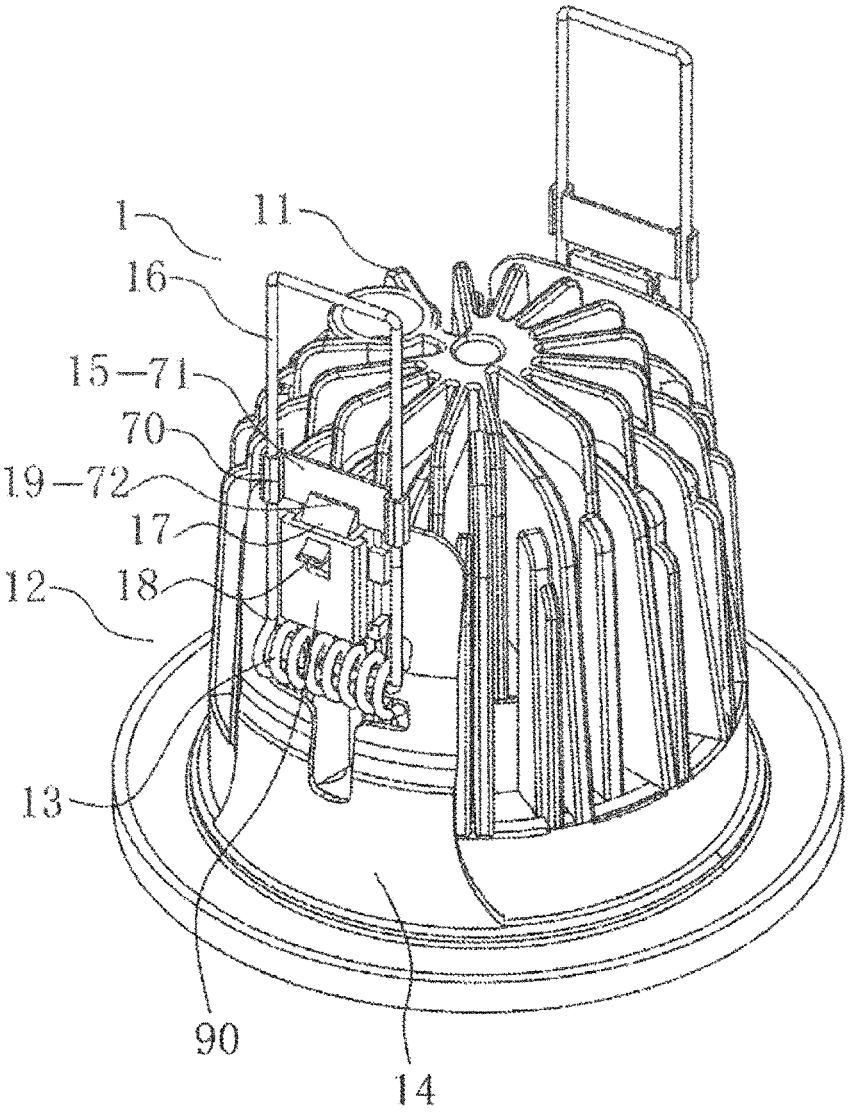
FIG. 2 is a perspective view of an automatic installation lamp according to a preferred embodiment of the present invention.
Figure 3:
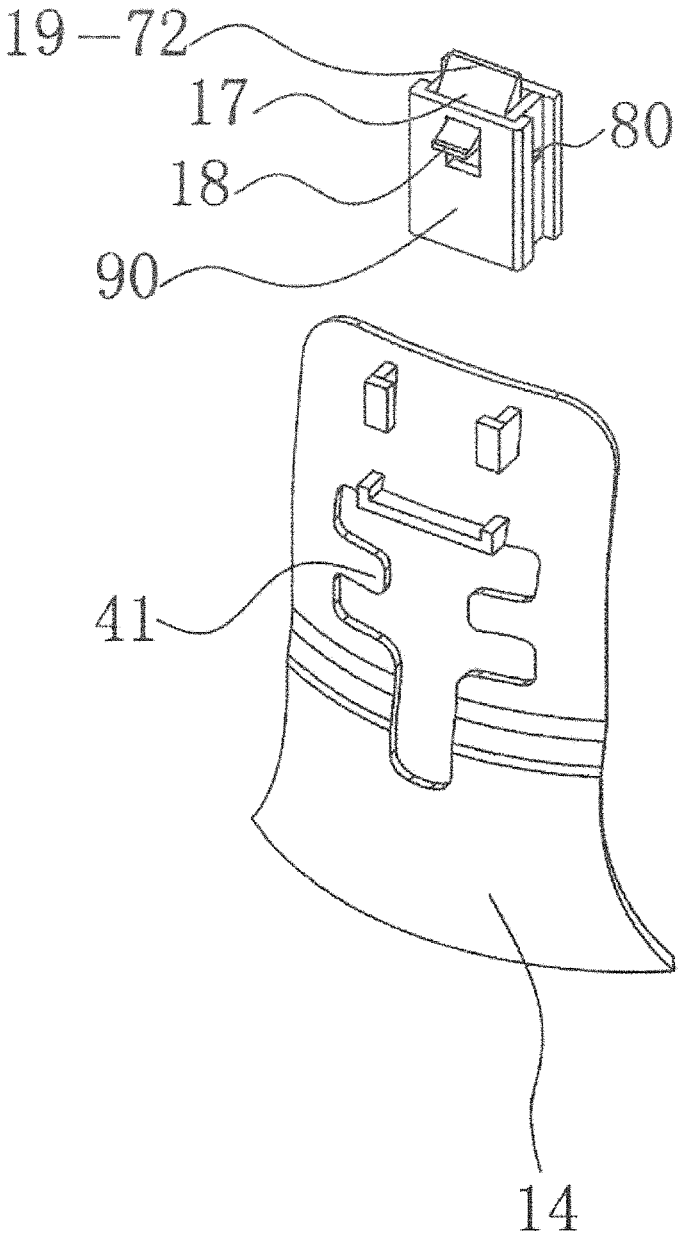
FIG. 3 is a perspective view of an automatic installation lamp according to the above preferred embodiment of the present invention, illustrating a fixing base, a triggering element, and a box body.
Figure 4:
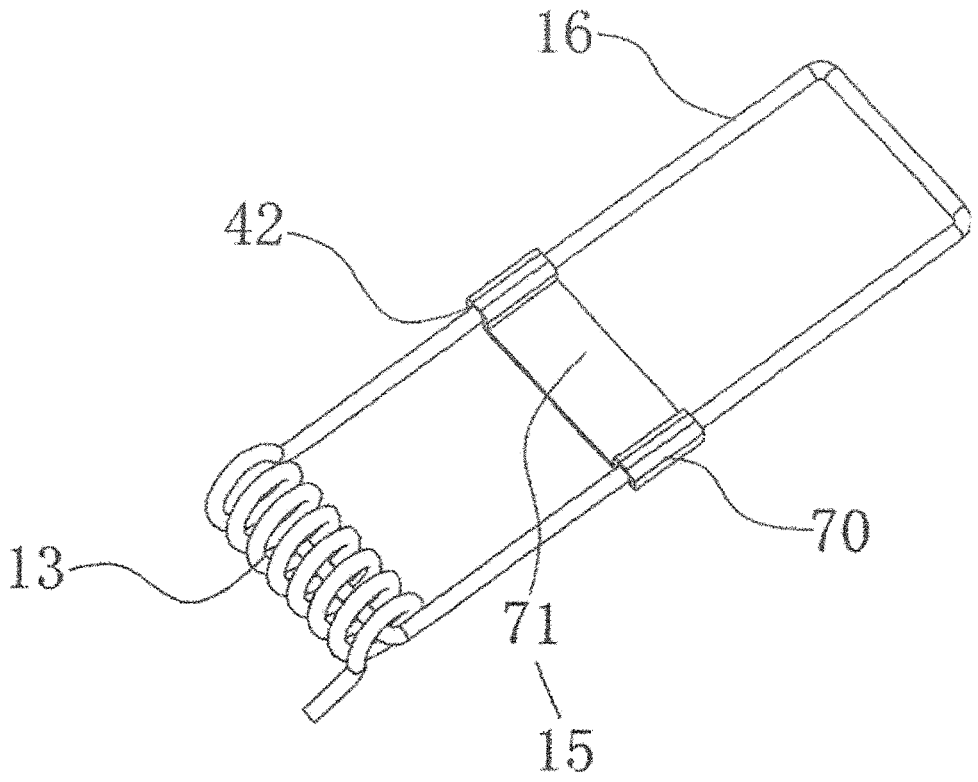
FIG. 4 is a perspective view of an automatic installation lamp according to the above preferred embodiment of the present invention, illustrating an elastic element, a fixing element, and a support element.

Referring to FIG. 2 to FIG. 4 of the drawings, an automatic installation lamp according to a preferred embodiment of the present invention is illustrated, wherein the automatic installation lamp is installed inside an installation hole 501 of a ceiling 500. Therefore, the automatic installation lamp 1 comprises a shell body 11 and at least one automatic installation mechanism 12, wherein the automatic installation mechanism 12 comprises an elastic element 13, a fixing base 14 installed on a side face of the shell body 11, and a support element 16 affixed on an outer side of the fixing base 14. One end of the support element 16 is rotatably connected with the side face of the fixing base 14, and the elastic element 13 is arranged between the support element 16 and the fixing base 14 to connect the support element 16 and the fixing base 14 respectively, wherein the free end of the support element 16 is adapted to pivotally move towards a lower portion of the fixing base 14 through the elastic element 13. The automatic installation mechanism further comprises a fixing element 70 arranged on the support element 16 and having a first catch element 15, and a limiting element 17, wherein the limiting element 17 is rotatably arranged on the side face of the fixing base 14 and is able to slide up-and-down along the support element 16. The limiting element 17 comprises a triggering element 18 and a second catch element 19, wherein while the triggering element 18 is activated to move away from the fixing base 14, the free end of the support element 16 is able to overcome a torsion provided by the elastic element 13, so that the free end of the support element 16 pivotally folds towards the upper portion of the fixing base 14 as well as that the second catch element 19 is hooked on the first catch element 15. In other words, while the triggering element 18 is activated to support the limiting element 17 being moved down or rotated along the support element 16, the second catch element 19 is detached from the first catch element 15.

That is to say, the support element 16 is able to perform two positions, In the first position, the support element 16 is erect, wherein the free end of the support element 16 is located on the upper portion of the one end of the support element 16, and the second catch element 9 is hooked on the first catch element 15. In the second position, the second catch element 19 is detached from the first catch element 15, and the free end of the support element 16 is located on a lower portion of the one end of the support element 16 and is biased against the shell body 11 or the fixing base 14. While the support element 16 is operated through the first position to the second position, the triggering element 18 is activated to force the limiting element 17 being slide down or rotated along the side face of the fixing base 14, so as to drive the second catch element 19 being detached from the first catch element 15, and then the free end of the support element 16 is pivotally moved towards the lower portion of the fixing base 14 through the torsion provided by the elastic element 13 in order to complete the second position. In other words, while the free end of the support element 16 is able to overcome the torsion provided the elastic element 13 (the action force is able to provide on the support element 16) to move towards the upper portion of the fixing base 14 in order to return to the first position, the second catch element 19 is hooked on the first catch element 15.

Figure 16:
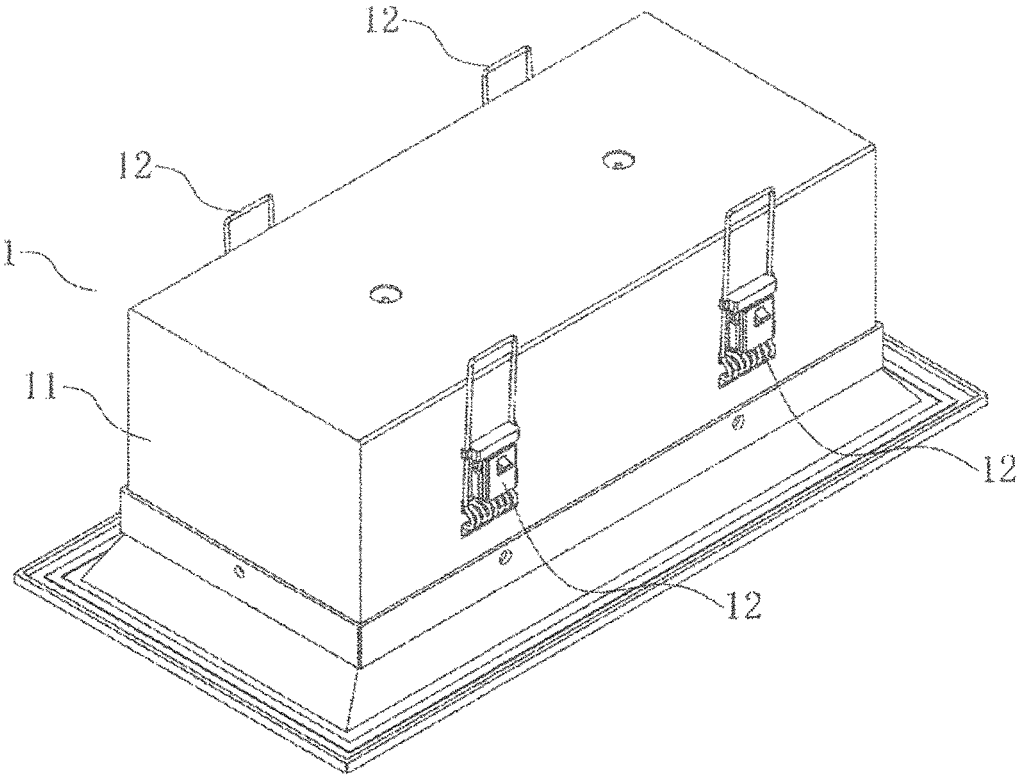
FIG. 16 is a perspective view of a sixth alternative mode of an automatic installation mechanism of the automatic installation lamp according to the above preferred embodiment of the present invention.

The number of the automatic installation mechanism 12 is based on the requirements. For example, more than one or multiple automatic installation mechanisms 12 can be provided on the present invention. If only one automatic installation mechanism 12 is provided in the present invention, the automatic installation lamp 1 cannot be fixedly installed on the ceiling, and the automatic installation lamp 1 is easy to fall down from the ceiling. If more than two automatic installation mechanisms 12 are provided in the present invention, as shown in FIG. 16, which is a seventh alternative mode of the automatic installation mechanism according to the preferred embodiment of the present invention, four automatic installation mechanisms 12 are provided to increase the stability of the installation for the automatic installation lamp 1, but the manufacturing cost of the automatic installation lamp 1 will be increased. Therefore, two automatic installation mechanisms 12 are normally applied on the automatic installation lamp 1, and the two automatic mechanisms 12 are symmetrically arranged on the automatic installation lamp 1 to provide acceptable stability of the installation for the automatic installation lamp 1 and to control the manufacturing cost therefor, as shown in FIG. 2 to FIG. 4. Of course, the two automatic installation mechanisms 12 can be non-symmetrically arranged on the automatic installation lamp 1, but the stability of the installation for the automatic installation lamp 1 may not strong enough.

The first catch element 15 and the second catch element 19 can be designed as any suitable structure. As shown in FIG. 2 to FIG. 4, in the preferred embodiment of the present invention, the first catch element 15 is a fixing plate 71, and the second catch element 19 is a baffle, wherein the free end of the support element 16 is pivotally moved towards the upper portion of the fixing base 14 by overcoming the torsion pf the elastic element 13, and then the baffle 72 is hooked on the fixing plate 71 so as to achieve that the second catch element 19 is hooked on the first catch element 15. In other words, while the triggering element 18 is activated to force the limiting element 17 being rotated or sliding down along the support element 16, the baffle 72 is moved down or rotated to detach from the fixing plate 71, so as to achieve that the second catch element 19 is detached from the first catch element 15.

It is worth mentioning that the first catch element 15 and the second catch element 19 can be designed as a through groove and a hook portion, a hook portion and a hook portion, and a hook portion and a plate type element.

Figure 6:
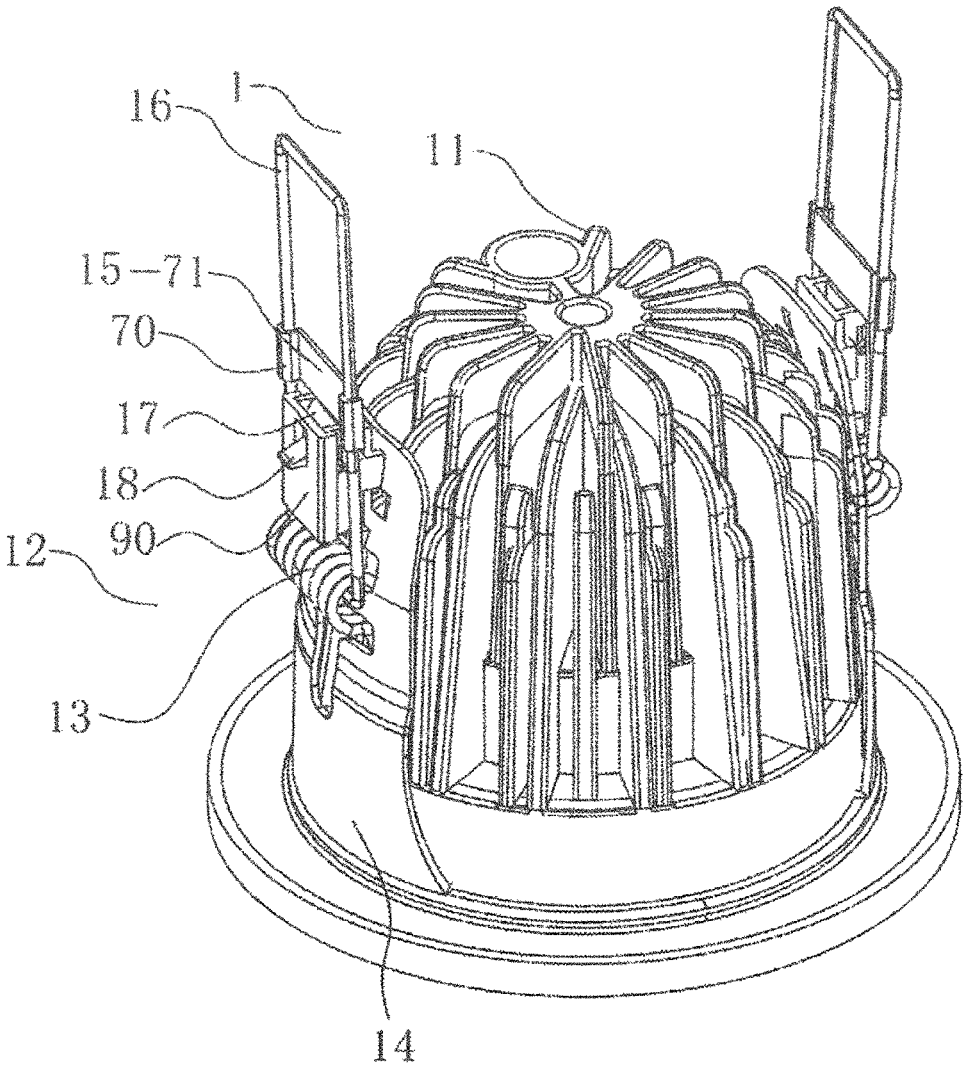

In order to facilitate the installation operation, as shown in FIG. 2 to FIG. 4, in the preferred embodiment of the present invention, the baffle 72 is a wedge-shaped baffle, wherein the wedge-shaped baffle has an inclined surface facing away from the fixing base 14, and the fixing plate 71 is touched with the inclined surface of the baffle 72 to force the baffle 72 moving down until the baffle 72 is hooked on the fixing plate 71 (as shown in FIG. 6).

Obviously, the installation position of the fixing plate 71 and the baffle 72 is exchangeable. That is to say, the first catch element 15 can be a baffle 72, and the second catch element 19 can be a fixing plate 71, which also can achieve the same purpose as mentioned above.

The number of the first catch element 15 and the second catch element 19 is based on the requirement, wherein one or more than one first and second catch elements 15, 19 can be provided in the present invention, However, the support element 16 cannot be stably fixed on the limiting element 17 by only one first and second catch element 15, 19, but if more than two first and second catch elements 15, 19 are used to connect the support element 16 and the limiting element 17, the stability between the support element 16 and the limiting element 17 is increased, but the manufacturing cost will increase also. Normally, two first and second catch elements 15, 19 are oppositely or parallelly arranged with each other, so as to provide a better stability and control the manufacturing cost. As shown in FIG. 2 to FIG. 4, in the preferred embodiment of the present invention, the number of the first and second catch element 15, 19 is also one, and the first and second catch element 15, 19 are hooked with each other. It is noted that a width of the first and second catch element 15, 19 is relatively wider to increase the stability between the support element 16 and the limiting element 17.

The limiting element 17 slidably or rotatably arranged on the side face of the fixing base 14 can be any kinds of suitable structure. As shown in FIG. 2 to FIG. 4, and FIG. 11 to FIG. 14, in the first to fifth alternative mode of the automatic installation mechanism according to the preferred embodiment of the present invention, the side surface of the fixing base 14 comprises a box body 90, wherein the limiting element 17 is slidably or rotatably arranged on the box body 90, and the limiting element 17 is able to slide up-and-down along the box body 90. The triggering element 18 is arranged through a side face of the box body 90, and the triggering element 18 is exposed through the side face of the box body 90, and is able to be slide up-and-down along the box body 90. The second catch element 19 is arranged through the top portion of the box body 90 and exposed outside to the box body 90.

The limiting element 17 is able to slide up-and-down along the box body 90 or rotatably arranged on the box body 90, wherein the limiting element 17 can be installed on the box body 90 through any suitable structure. As shown in FIG. 2 to FIG. 4 and FIG. 11 to FIG. 14, in the first to fifth alternative mode of the automatic installation mechanism according to the preferred embodiment of the present invention, two sides of the box body 90 comprises two symmetrically arranged guiding grooves 80, and two sides of the limiting element 17 comprises two symmetrically arranged guiding shafts 81, wherein the guiding shafts 81 are arranged inside the guiding grooves 80.

The guiding grooves 80 can be any kinds of suitable structure, as shown in FIG. 2 to FIG. 4 and FIG. 11 to FIG. 14, in the first to fifth alternative mode of the automatic installation mechanism according to the preferred embodiment of the present invention, the guiding grooves 80 are L-shaped guiding grooves.

Figure 11:
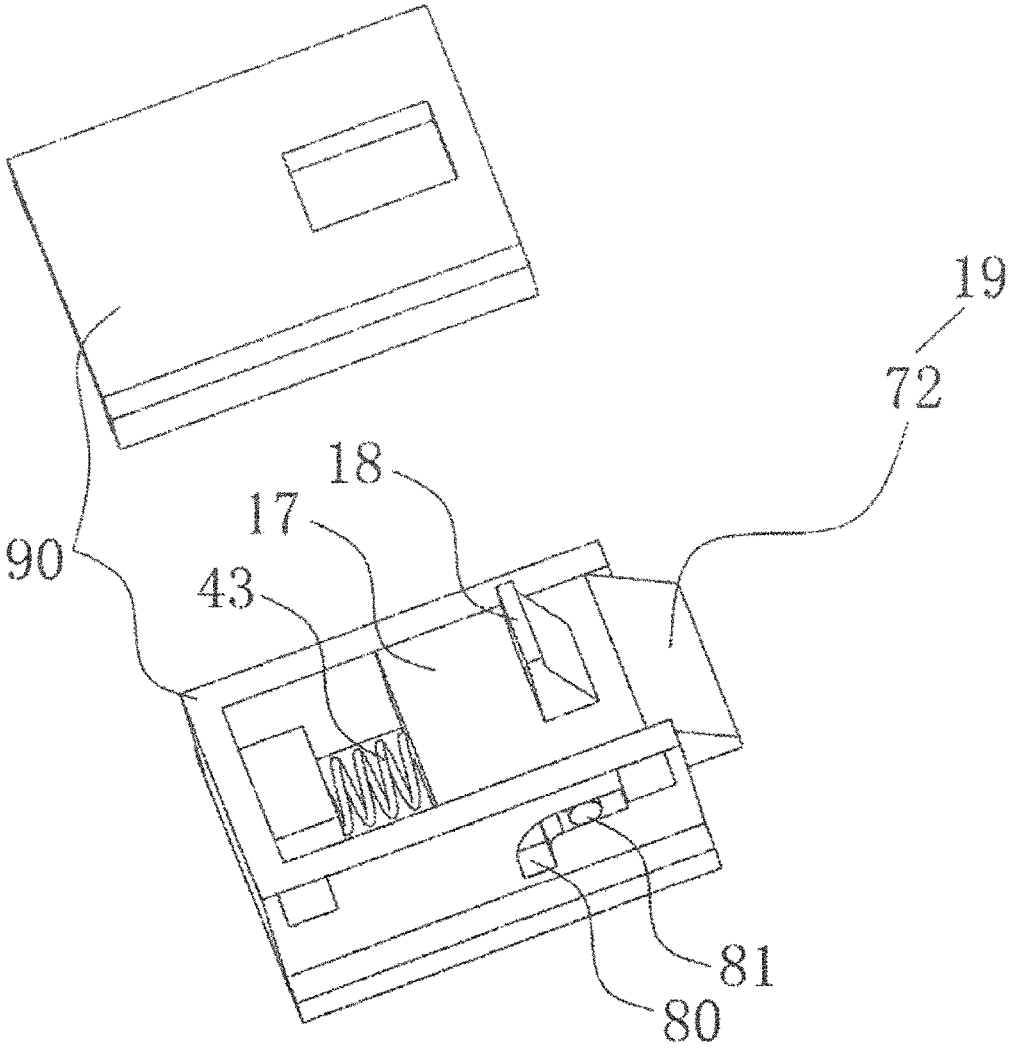
FIG. 11 is a perspective view of a first alternative mode of an automatic installation mechanism of the automatic installation lamp according to the above preferred embodiment of the present invention.
Figure 12:
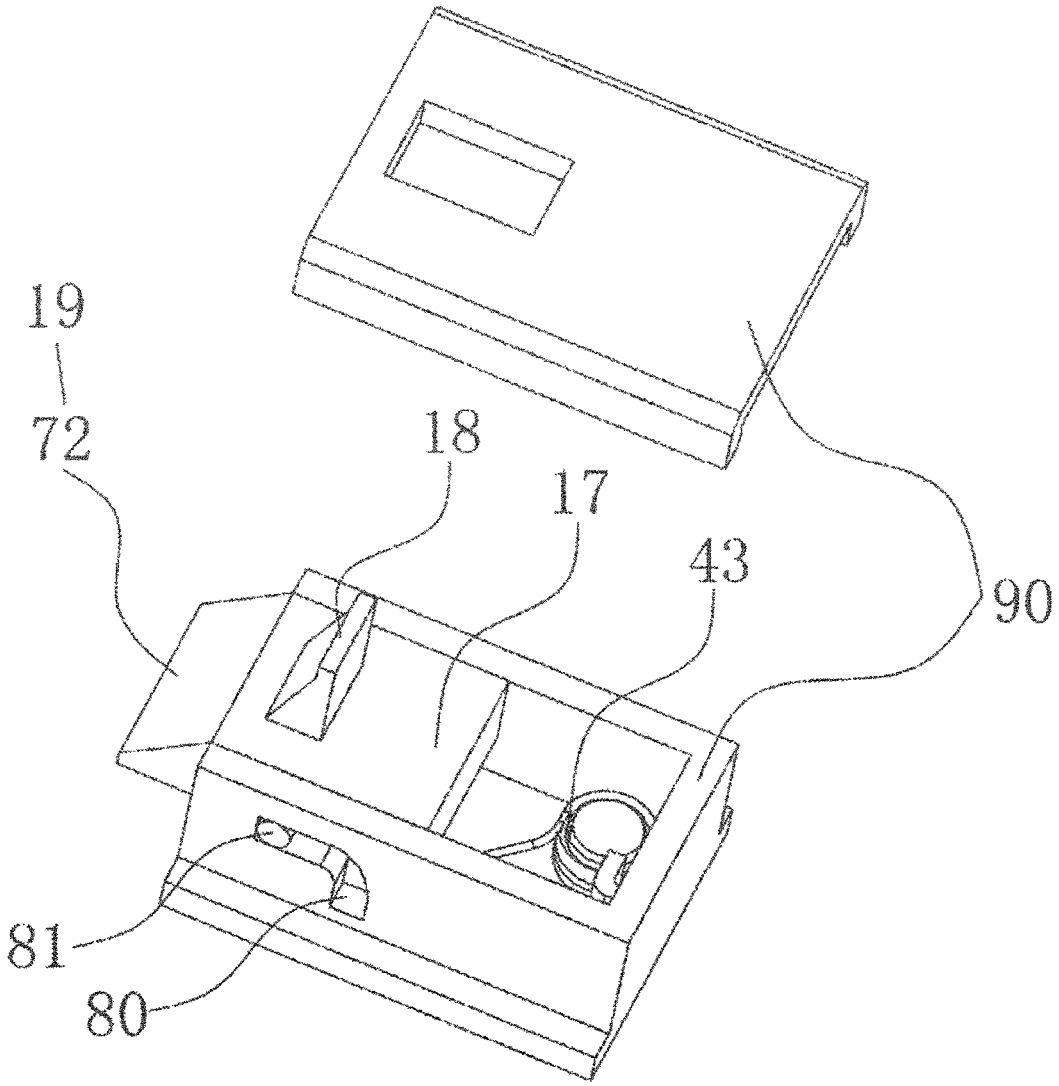
FIG. 12 is a perspective view of a second alternative mode of an automatic installation mechanism of the automatic installation lamp according to the above preferred embodiment of the present invention.
Figure 13:
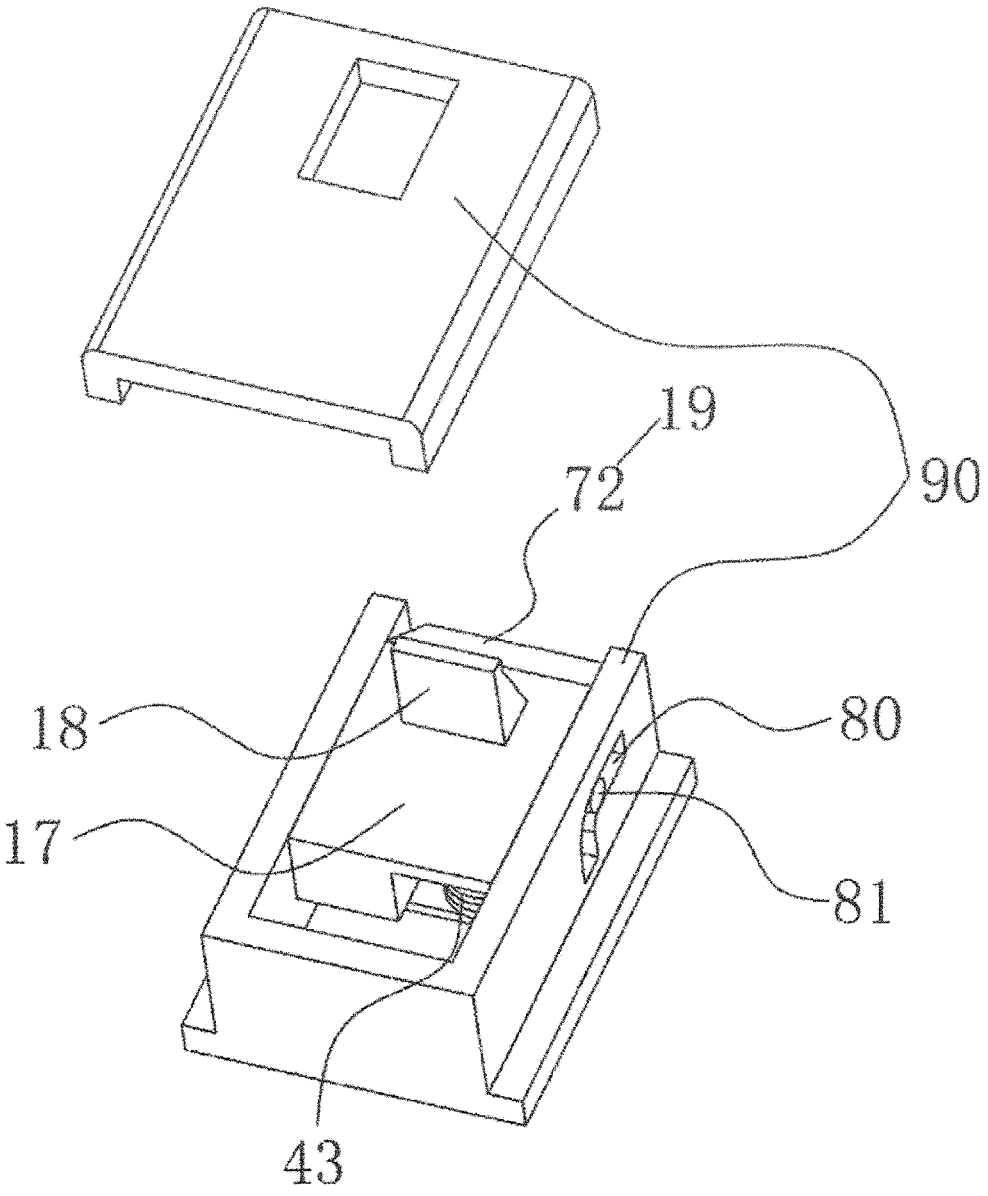
FIG. 13 is a perspective view of a third alternative mode of an automatic installation mechanism of the automatic installation lamp according to the above preferred embodiment of the present invention.

The limiting element 17 is able to slide up-and-down and arranged on the side face of the fixing base 14, wherein while the triggering element 18 is activated to force the limiting element 17 being moved down, the second catch element 19 is detached from the first catch element 15, and after that, in order to force the limiting element 17 being reset, preferably, the automatic installation mechanism 12 further comprises an elastic resetting element 43 erectly arranged between the limiting element 17 and the fixing base 14, and the elastic resetting element 43 is biased against the limiting element 17 and the fixing base 14. While an external force applied the triggering element 18 is released, the limiting element 17 is moved down to reset to its original position through an action force provided by the elastic resetting element 43 to ensure the second catch element 19 to be engaged with the first catch element 15. As shown in FIG. 11 to FIG. 13, in the first to third alternative mode of the automatic installation mechanism according to the preferred embodiment of the present invention, the elastic resetting element 43 is erectly arranged between the limiting element 17 and the box body 90, and the elastic resetting element 43 is biased against the limiting element 17 and the box body 90.

The elastic resetting element 43 can be designed as any kinds of suitable structure, wherein the elastic resetting element 43 can be a spring or an elastic body. As shown in FIG. 11, in the first alternative mode of the automatic installation mechanism according to the preferred embodiment of the present invention, the elastic resetting element 43 is a spring. As shown in FIG. 12 and FIG. 13, in the second and third alternative mode of the automatic installation mechanism according to the preferred embodiment of the present invention, the elastic resetting element 43 is a helicoid spring. It is noticed that, as shown in FIG. 12, in the second alternative mode of the automatic installation mechanism according to the preferred embodiment of the present invention, the helicoid spring is erectly arranged between he limiting element 17 and the box body 90, and the helicoid spring is biased against the lower end of the limiting element 17 and the box body 90. As shown in FIG. 13, in the third alternative mode of the automatic installation mechanism according to the preferred embodiment of the present invention, the helicoid spring is arranged inside the limiting element 17, and arranged between the limiting element 17 and the box body 90, and the helicoid spring is biased against the limiting element 17 and the box body 90.

Figure 14:
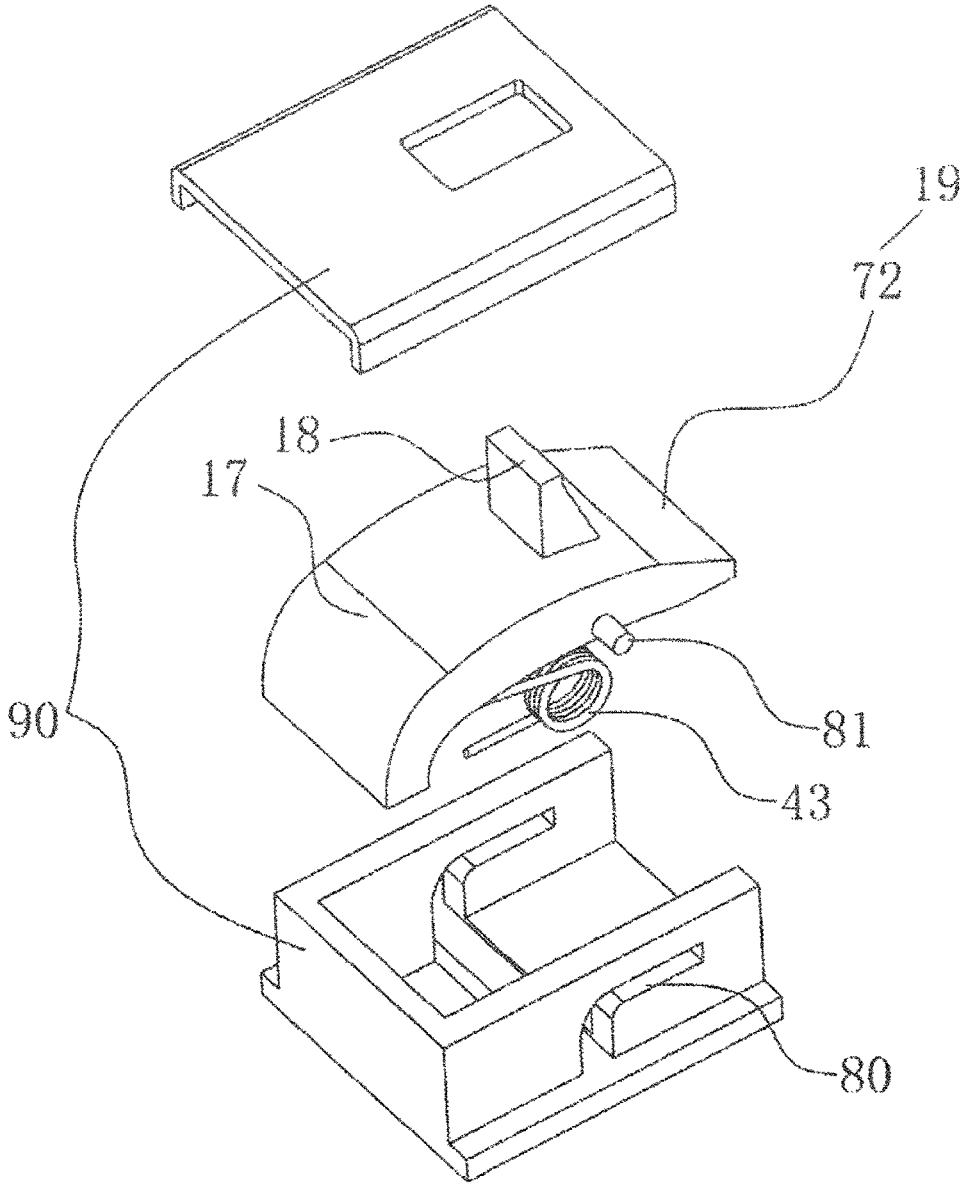
FIG. 14 is a perspective view of a fourth alternative mode of an automatic installation mechanism of the automatic installation lamp according to the above preferred embodiment of the present invention.

The limiting element 17 is rotatably arranged on the side face of the fixing base 14. While the triggering element 18 is activated by the external force to force the limiting element 17 being rotated downward, the second catch element 19 is detached from the first catch element 15. After that, in order to force the limiting element 17 being reset, preferably, the automatic installation mechanism 12 further comprises an elastic resetting element 43 arranged inside the limiting element 17, and arranged between the limiting element 17 and the fixing base 14, so as to force the limiting element 17 being rotated towards the upper portion of the fixing base 14. As shown in FIG. 14, in the fourth alternative mode of the automatic installation mechanism according to the preferred embodiment of the present invention, the automatic installation mechanism comprises an elastic resetting element 43, wherein the elastic resetting element 43 is arranged inside the limiting element 17, and arranged between the limiting element 17 and the box body 90, so as to force the limiting element 17 being rotated towards the upper portion of the fixing base 14.

Similarly, the elastic resetting element 43 can be designed as any kinds of suitable structure. As shown in FIG. 14, in the fourth alternative mode of the automatic installation mechanism according to the preferred embodiment of the present invention, the elastic resetting element 43 is a helicoid spring.

Figure 15:
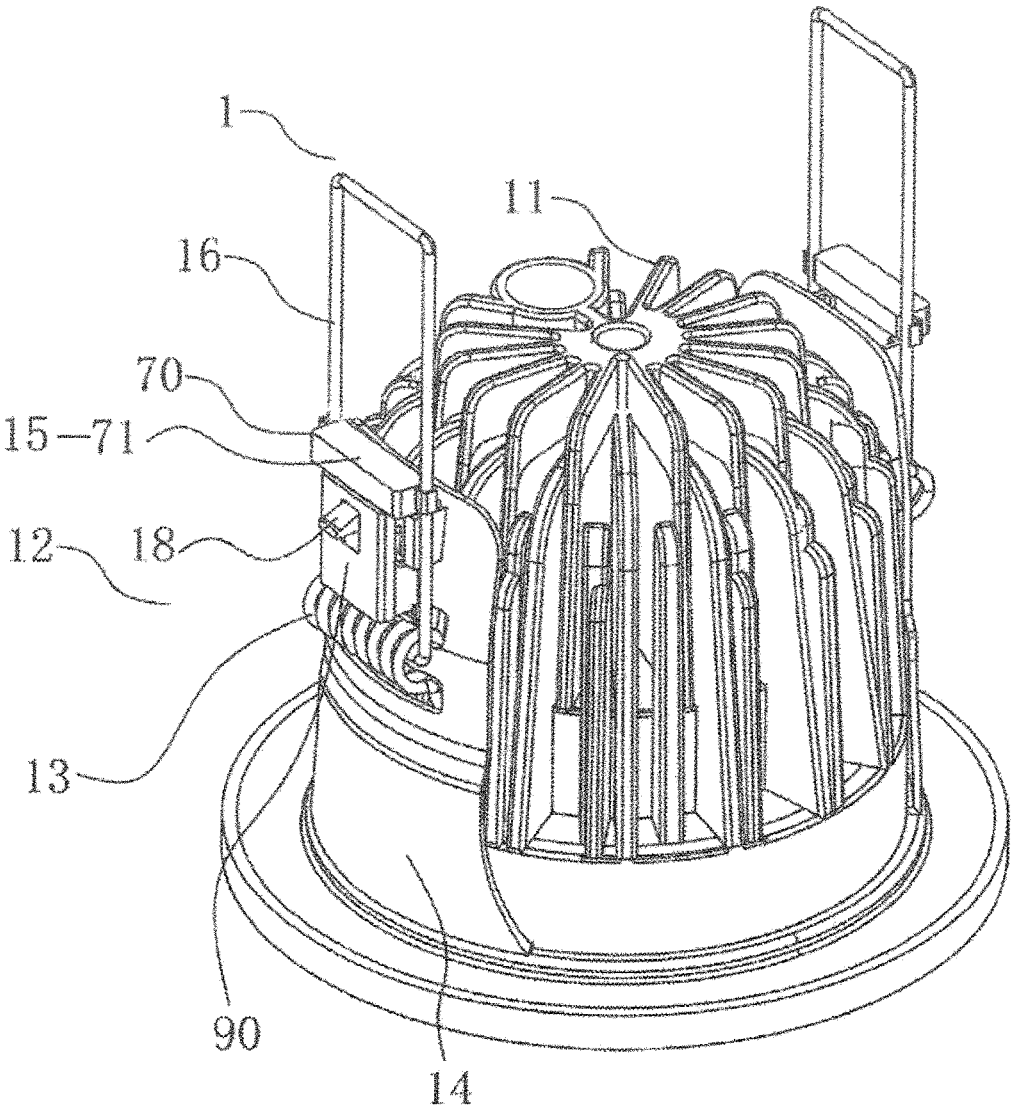
FIG. 15 is a perspective view of a fifth alternative mode of an automatic installation mechanism of the automatic installation lamp according to the above preferred embodiment of the present invention.

As shown in FIG. 15, in the fifth alternative mode of the automatic installation mechanism according to the preferred embodiment of the present invention, the first catch element 15 is a fixing groove 91 having an opening facing towards one end of the support element 16, wherein the second catch element 19 is a baffle 72 (as shown in FIG. 2), and the free end of the support element 16 is adapted to overcome the torsion provided by the elastic element 13 and is pivotally moved towards the upper portion of the fixing base 14. The baffle 72 is deposed inside the fixing groove 91 and is hooked into the fixing groove 91, wherein the fixing groove 19 is formed close to the side face of the fixing base 14, so as to achieve that the fixing groove 91 being hooked into the first catch element 15. In other words, while the triggering element 18 is activated by the external force to force the limiting element 17 being rotated or slide downwardly, the baffle 72 is moved downward or rotated to detach from the fixing groove 91, so that the second catch element 19 is detached from the first catch element 15.

The one end of the support element 16 rotatably connected to the side face of the fixing base 14 can be any kinds of suitable structure. As shown in FIG. 2 to FIG. 4, in the preferred embodiment of the present invention, the elastic element 13 is rotatably connected with the side face of the fixing base 14, and is connected with the one end of the support element 16 and the fixing base 14 respectively. In other words, the one end of the support element 16 is rotatably connected to the side face of the fixing base 14.

More specifically, the elastic element 13 is a hollow structure, wherein the side face of the fixing base 14 comprises a pair of symmetrically arranged protruded portions 41, and two ends of the elastic element 13 are coupled on the two protruded portions 41, so as to achieve that the elastic element 13 is rotatably coupled on the side face of the fixing base 14.

The elastic element 13 and the support element 16 are formed as a whole, and the elastic element 13 and the support element 16 can be two separated elements connected with each other. As shown in FIG. 2 to FIG. 4, in the preferred embodiment of the present invention, the elastic element 13 and the support element 16 are formed as a whole.

The elastic element 13 can be any kinds of suitable components, which is able to force the free end of the support element 16 being pivotally moved towards the lower portion of the fixing base 14. As shown in FIG. 2 to FIG. 4, in the preferred embodiment of the present invention, the elastic element 13 is a helicoid spring.

The support element 16 can be designed as any kinds of suitable structure, such as a rod or a sheet. As shown in FIG. 2 to FIG. 4, in the preferred embodiment of the present invention, the support element 16 is a U-shaped support element, wherein two free ends of the U-shaped support element are connected with the elastic element 13, and two ends of the fixing element 70 are arranged on the support element 16.

The two ends of the fixing element 70 are linked with the support element 16 by any kinds of suitable structure. As shown in FIG. 2 to FIG. 4, in the first preferred embodiment of the present invention, the two ends of the fixing element 70 comprises two coupling grooves 42, wherein an opening of the coupling groove 42 is smaller than the inner portion of the coupling groove 42, so that two legs of the U-shaped support element are coupled inside the coupling groove 42 through the opening.

The fixing element 70 can be fixedly linked to the support element 16 by a bot, a nut, the welding skill, or other well-known skills.

The triggering element 18 can be designed as any kinds of suitable structure, such as a rod or a sheet. As shown in FIG. 2 to FIG. 4 and FIG. 11 to FIG. 14, in the first to fourth alternative mode of the automatic installation mechanism according to the preferred embodiment of the present invention, the triggering element 18 is a sheet-shaped element.

Figure 5:
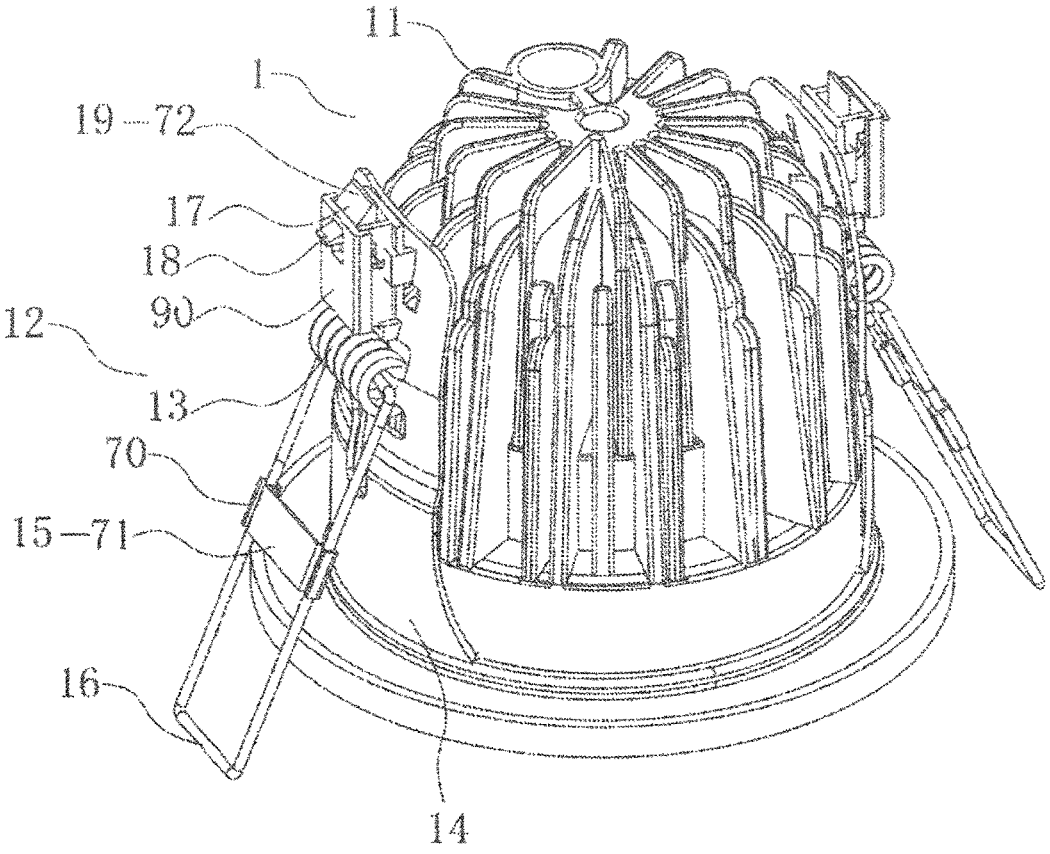
FIG. 5 to FIG. 10 shows an installation step for an automatic installation lamp according to the above preferred embodiment of the present invention.
Figure 7:
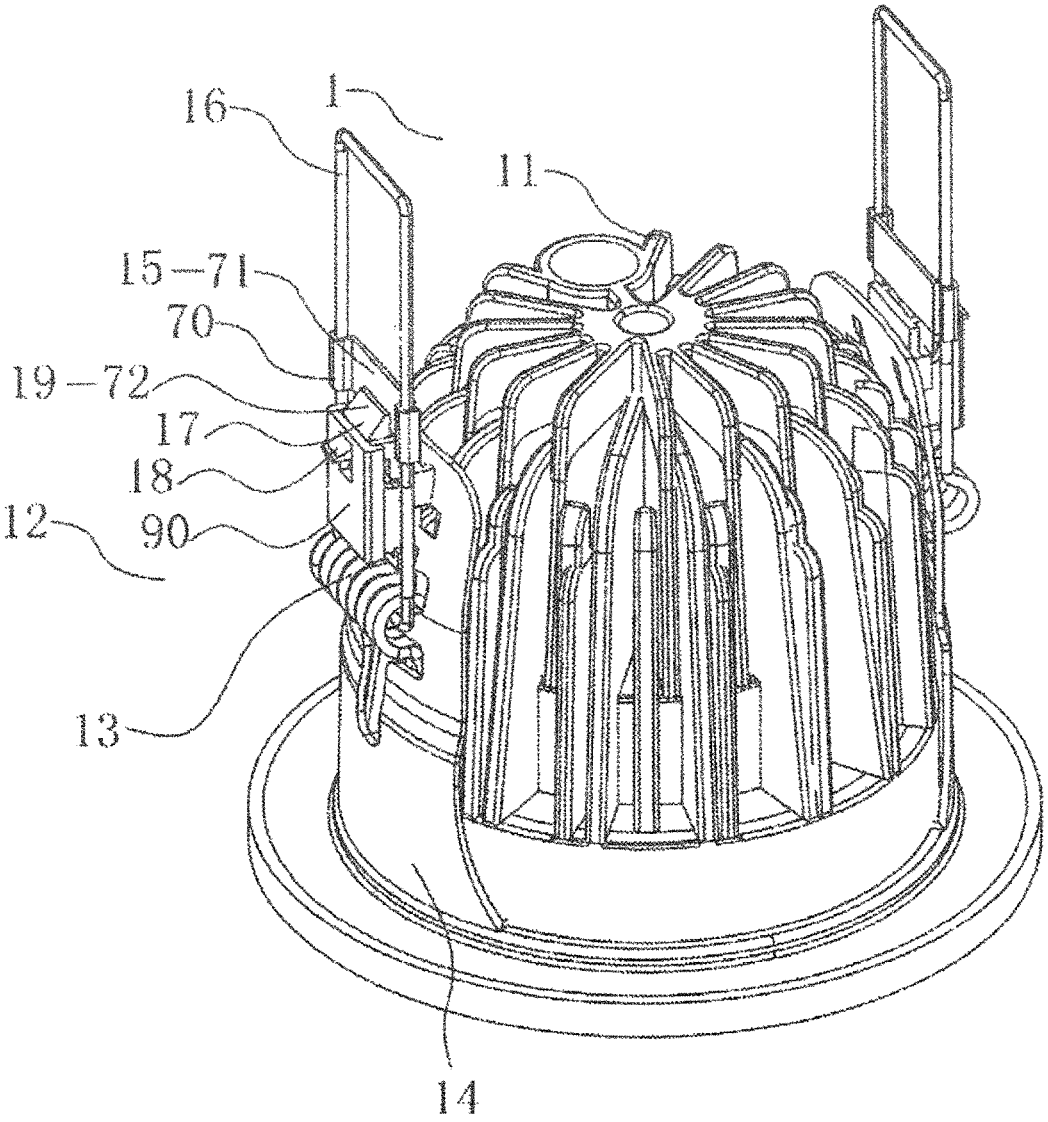
Figure 8:
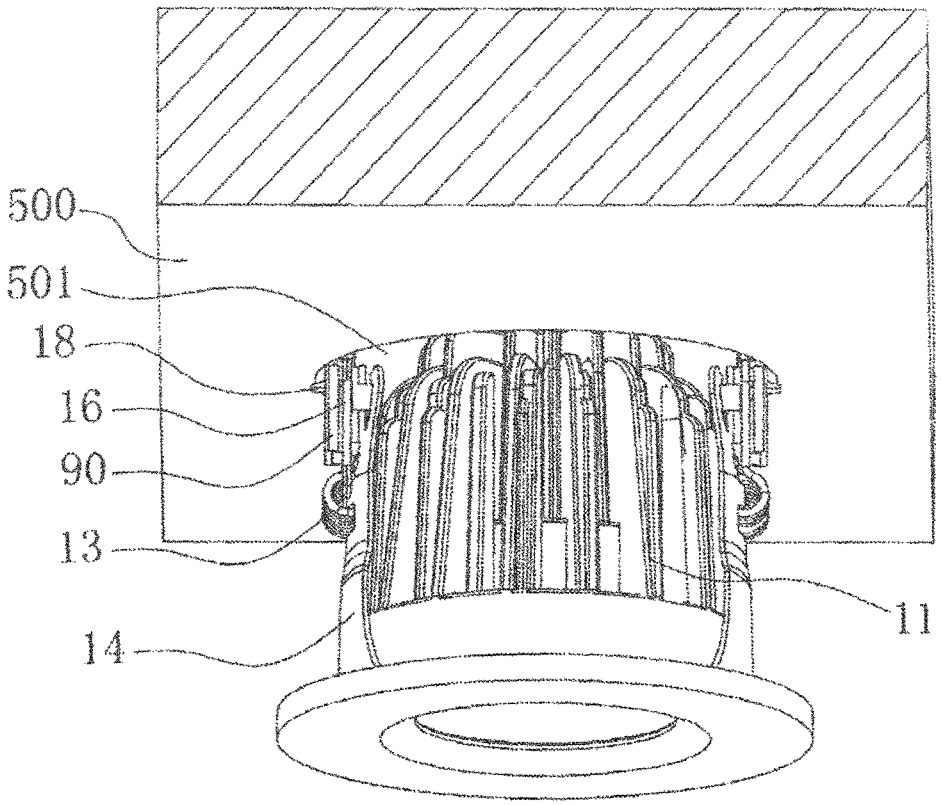
Figure 9:
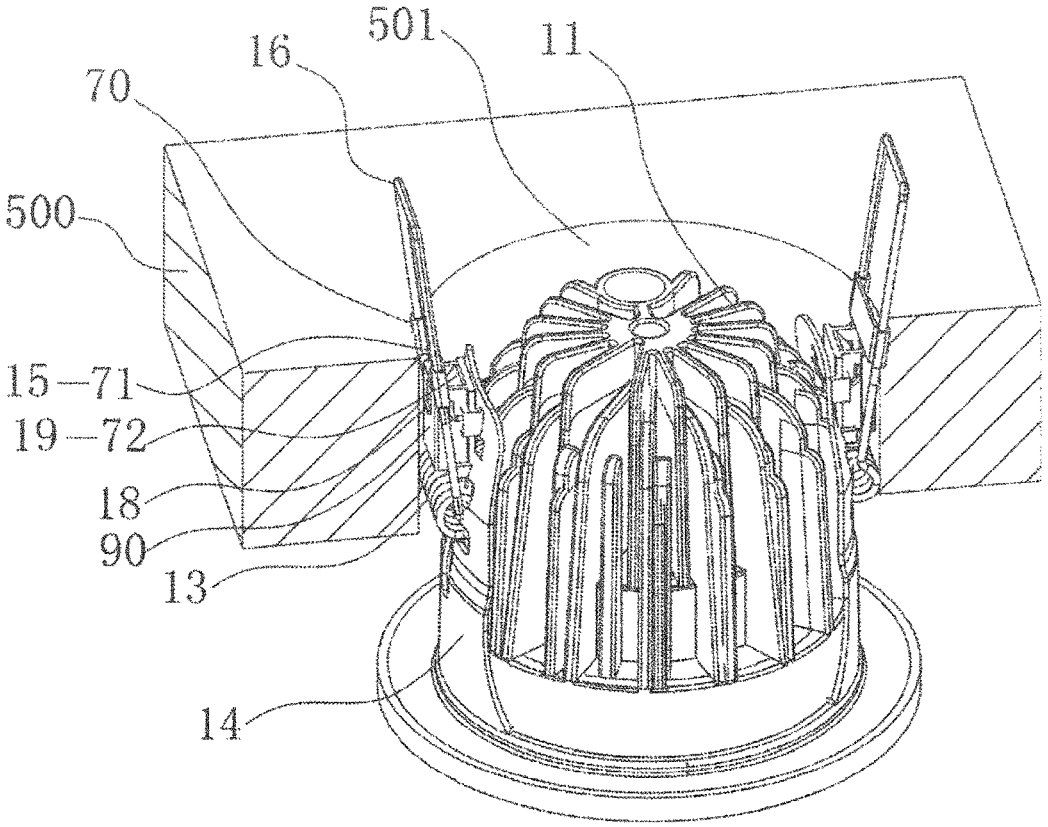
Figure 10:
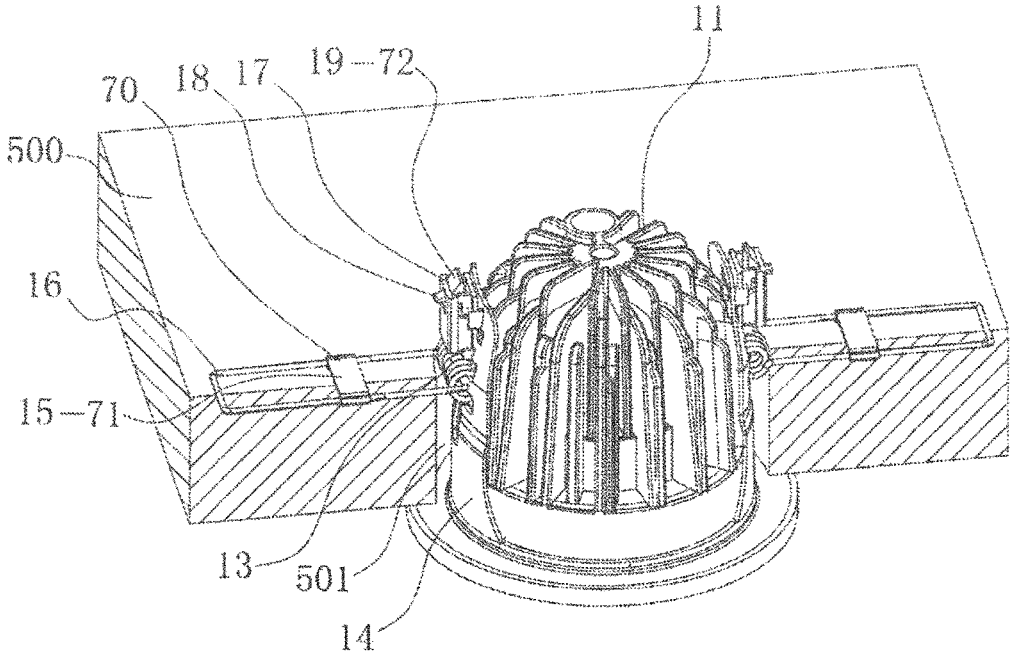

Referring to FIG. 5 to FIG. 10 of the drawings, an operation process for the automatic installation mechanism 12 in the preferred embodiment of the present invention is illustrated. FIG. 5 shows the automatic installation lamp 1 before the installation. The support element 16 is in the second position, wherein the free end of the support element 16 is located at a position close to the lower portion of the fixing base 14 b the torsion provided by the elastic element 13. As shown in FIG. 5 to FIG. 7, the free end of the support element 16 is pivotally moved towards the upper portion of the fixing base 14 and to overcome the torsion provided by the elastic element 13 (if the elastic element 13 is a helicoid spring, the action force is a torsion of the helicoid spring) until the support element 16 being a upward and erect situation, which is the first position for the support element 16 (as shown in FIG. 2 and FIG. 7). In such manner, the triggering element 18 of the limiting element 17 is exposed to outside, and the second catch element 19 of the limiting element 17 is hooked on the first catch element 15 of the fixing element 70, so as to remain the support element 16 in the first position. Therefore, the support element 16 will not be pivotally moved towards the lower portion of the fixing base 14 through the torsion provided by the elastic element 13 (the first position). At the same time, the external force exerted on the support element 16 can be released, as shown in FIG. 8 and FIG. 9, and the then the shell body 11 with the support element 16 can be inserted into the installation hole 501 of the ceiling 500. Since the triggering elements 18 are extended oppositely with a diameter therebetween slightly larger than a diameter of the installation hole 501, the triggering element 18 exposed outside the box body 90 is activated by a downward force from the ceiling 500, so that the limiting element 17 is slide or rotated along the side face of the fixing base 14, so as to cause the second catch element 19 being moved downward and being detached from the first catch element 15. In other words, the triggering element 18 is actuated by an opening rim of the installation hole 501 when the lamp is inserted thereinto. And then, the support element 16 is pivotally moved downward towards the lower portion of the fixing base 14 by the torsion provided by the elastic element 13, so that the ceiling 500 is remained between the support element 16 and a lower protruded edge of the shell body 11, as shown in FIG. 10. The installation for the automatic installation lamp 1 is completed.

Referring to FIG. 11 to FIG. 16 of the drawings, the installation process for the first and sixth alternative mode of the automatic installation mechanism according to the preferred embodiment of the present invention is the same as mentioned above.

The automatic installation mechanism 12 not only can be installed on the lamps, but also can be installed on other objects, such as ornaments.

Figure 17:
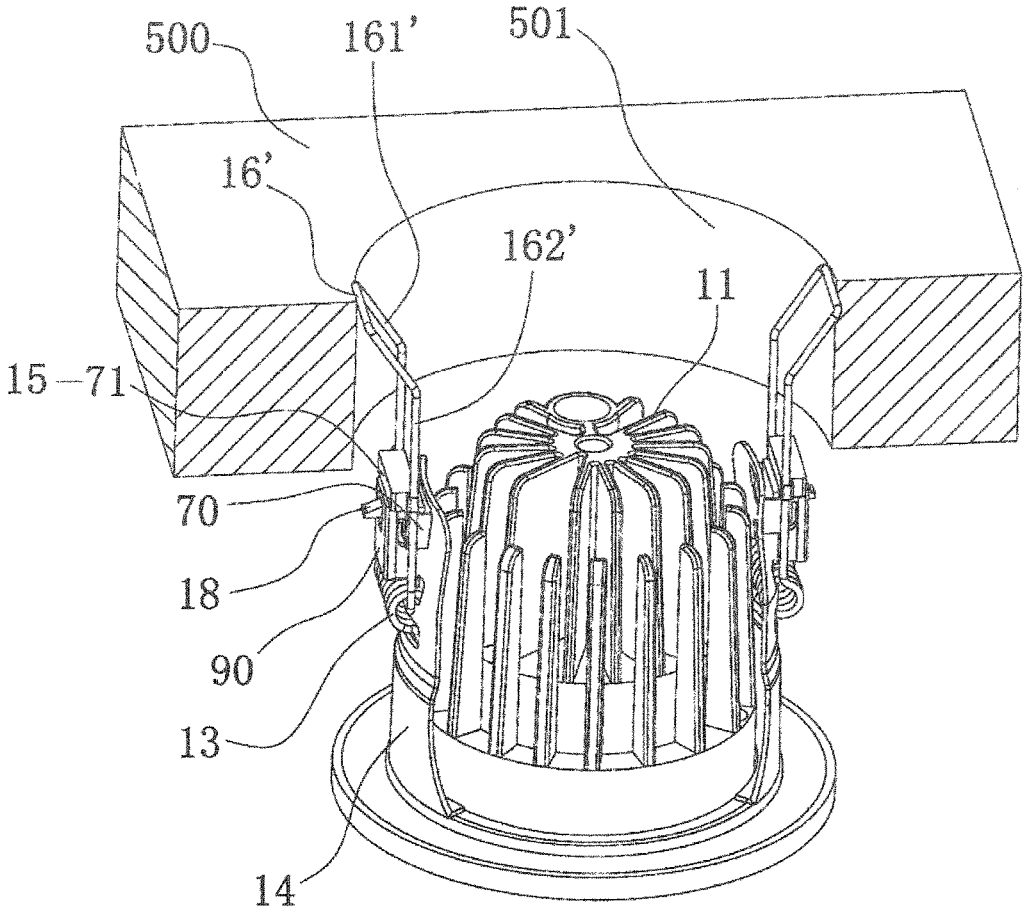
FIG. 17 is a perspective view of an automatic installation lamp according to the above preferred embodiment of the present invention, illustrating the automatic installation lamp which is detaching from the ceiling, and the support element is fixed at the first position.

FIG. 17 is a detaching process for the automatic installation lamp according to the preferred embodiment of the present invention, wherein the automatic installation lamp 1 is detached from the installation hole 501 by the support element 16'. The support element 16' comprises a guiding end portion 161' and a supporting end portion 162', wherein one end of the supporting end portion 162' is connected to the elastic element 13 and the other end of the supporting end portion 162' is connected to the guiding end portion 161'. While the automatic installation lamp 1 is installed into the installation hole 501 and is prepared to detach from the installation hole 501, as shown in FIG. 17, the automatic installation lamp 1 is moved away from the installation hole 501. The action force is applied to the support element 16 by the installation hole 501', so as to cause the support element 16' for overcoming the torsion from the elastic element 13, and then the support element 16' is pivotally moved towards the upper portion of the fixing base 14, so as to force the guiding end portion 161' of the support element 16' being moved close to the fixing base 14. While the guiding end portion 161' of the support element 16' is touched with the installation hole 501', the guiding end portion 161' of the support element 16' is moved along the inner edge of the installation hole 501', and then the supporting end portion 162' of the support element 16' is moved close to the second catch element 19. That is to say, the first catch element 15 of the supporting end portion 162' of the support element 16' is moved close to the second catch element 19. While the first catch element 15 and the second catch element 19 are contacted with each other, the second catch element 19 is a baffle 72, and furthermore, the baffle 72 is a wedge-shaped baffle. The first catch element 15 is touched with the inclined surface of the baffle 72 in order to push the baffle being moved downwardly. After that, the baffle 72 is hooked on the first catch element 15. In other words, the first catch element 15 is locked in the first position. While the support element 16 is moved to leave the installation hole 501, the first catch element 15 is locked in the first position, so that the support element 16 will not be pivotally moved towards the lower portion of the fixing base 14, so as to prevent the installation being injured.

Figure 18:
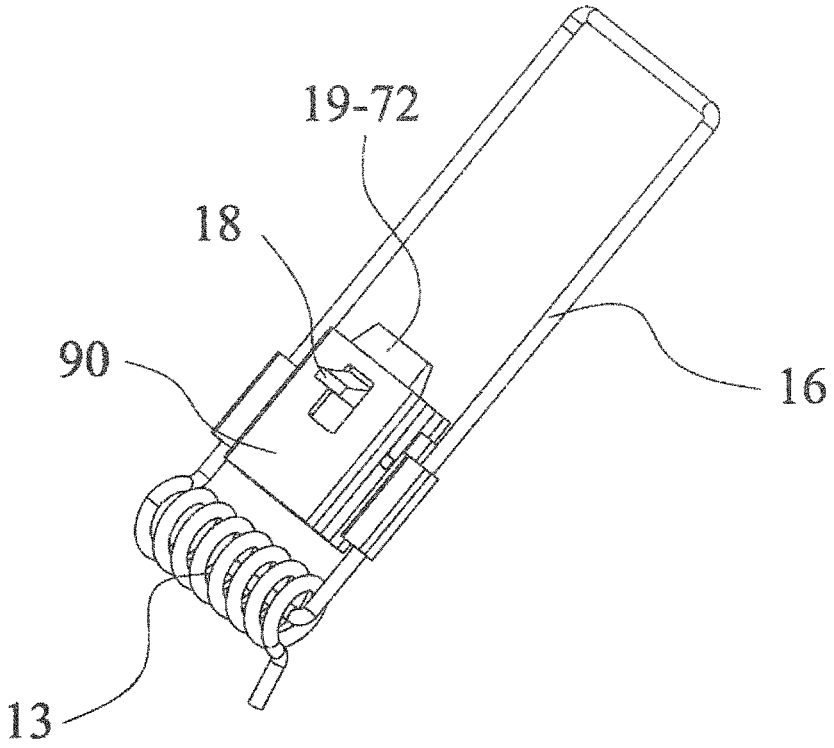
FIG. 18 is a perspective view of a seventh alternative mode of an automatic installation mechanism of the automatic installation lamp according to the above preferred embodiment of the present invention, illustrating an elastic element, a triggering element, and a support element.
Figure 19:
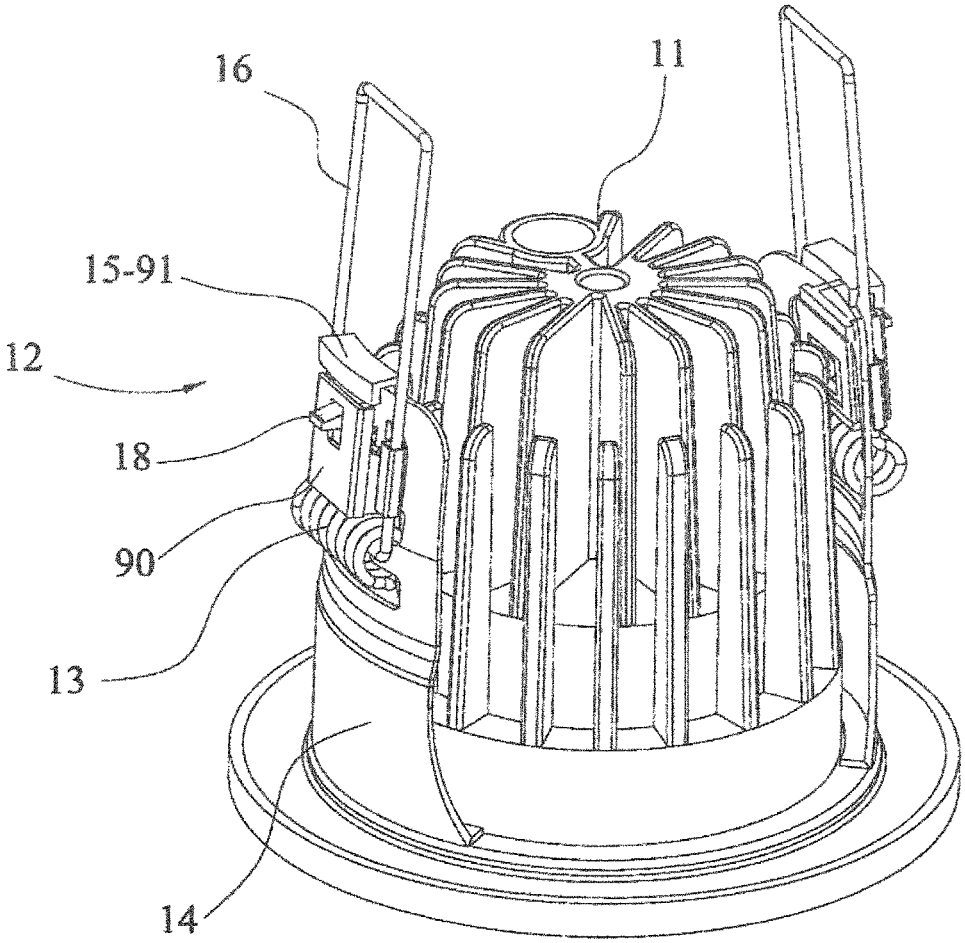
FIG. 19 is a perspective view of the seventh alternative mode of an automatic installation mechanism of the automatic installation lamp according to the above preferred embodiment of the present invention, illustrating the support element which is in the first position.
Figure 20:
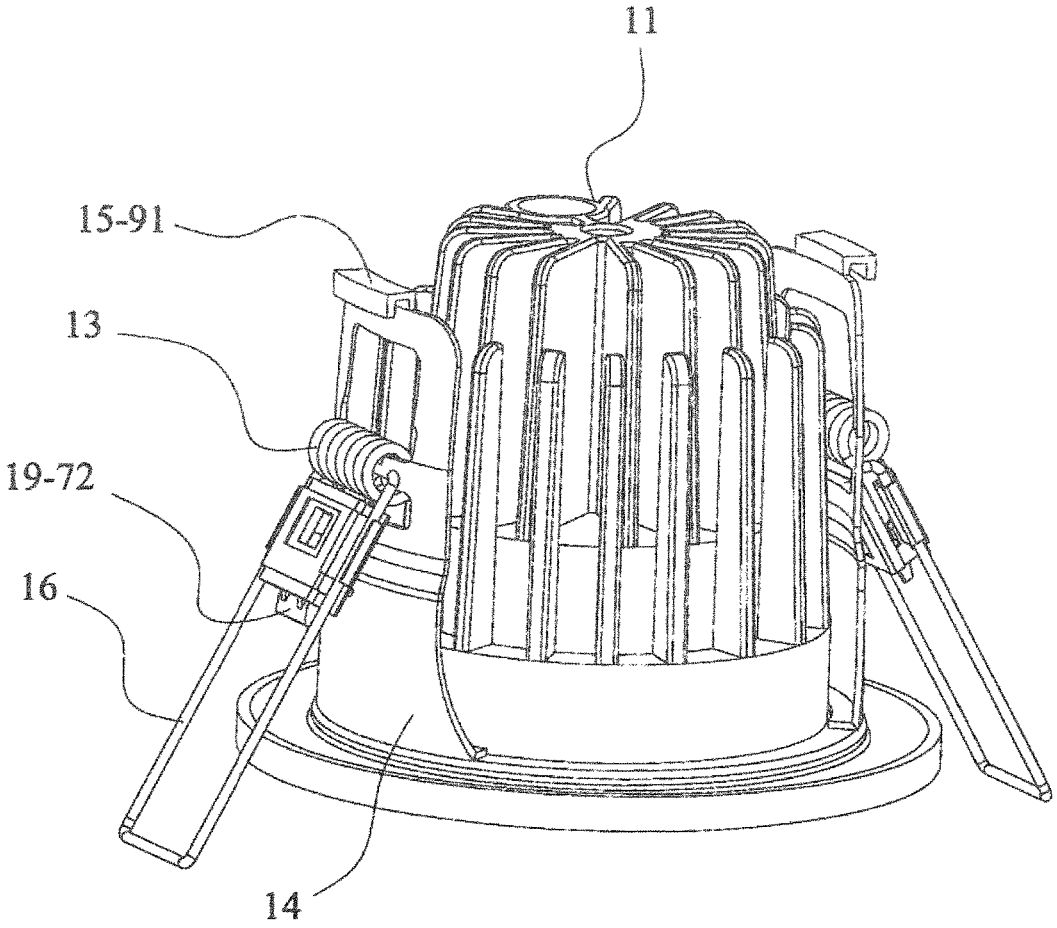
FIG. 20 is a perspective view of the seventh alternative mode of an automatic installation mechanism of the automatic installation lamp according to the above preferred embodiment of the present invention, illustrating the support element which is in the second position.

Referring to FIG. 18 to FIG. 20 of the drawings, an eighth alternative mode of the automatic installation mechanism according to the preferred embodiment of the present invention is illustrated. The different between this alternative mode and the above mentioned alternative mode is that the position of the fixing element 70 and the limiting element 17 is exchanged. In other words, the limiting element 17 is arranged on the support element 16, and the fixing element 70 is arranged on the fixing base 14.

The limiting element 17 is slidably or rotatably arranged on the support element 16. Preferably, the limiting element 17 is moved along the support element 16. The limiting element 17 further comprises the triggering element 18 and the second catch element 19. Preferably, the triggering element 18 is arranged on the limiting element 17 and is extended away from the side face of the fixing base 14. The limiting element 17 is rotatably arranged on the box body 90 and is able to slide up-and-down with any kinds of suitable structure. The structure of the limiting element 17 arranged inside the box body 90 is the same as the structure mentioned above, as shown in FIG. 11 to FIG. 14. The limiting element 17 is arranged on a top end portion of the fixing base 14. The fixing element 70 comprises a first catch element 15, wherein while the second catch element 19 is hooked on the first catch element 15, the support element 16 is locked to stop for rotating towards the lower portion of the fixing base 14. That is to say, the limiting element 17 is adapted to force the support element 16 in the first position. While the second catch element 19 is detached from the first catch element 15, the support element 16 can be pivotally moved towards the lower portion of the fixing base 14. In this eighth alternative mode, preferably, the first catch element 15 is a fixing groove 91, and the second catch element 19 is a baffle 72. The free end of the support element 16 is adapted to overcome the torsion provided by the elastic element 13 and is pivotally moved towards the upper portion of the fixing base 14. The baffle 72 is disposed inside the fixing groove 91 and is hooked into the fixing groove 91, wherein the fixing groove 19 is moved away from the side face of the fixing base 14, so as to achieve that the fixing groove 91 being hooked into the first catch element 15. In other words, while the triggering element 18 is activated by the action force to force the limiting element 17 being rotated or slide downward, the baffle 72 is moved downward or rotated to detach from the fixing groove 91, so that the second catch element 19 is detached from the first catch element 15. While the first catch element 15 and the second catch element 19 are hooked with each other, the second catch element 19 can be protected inside the fixing groove 91, so as to prevent the second catch element 19 being damaged.

An installation method for the automatic installation lamp comprises the following steps:

1. Prevent the free end of the support element 16 being pivotally moved towards the lower portion of the fixing base 14. In other words, the support element 16 is remained in the first position. A restoring force is applied on the support element 16 by the elastic element 13 to force the free end of the support element 16 being pivotally moved to the upper portion of the fixing base 14. The second catch element 19 is adapted to lock with the first catch element 15, so as to stop the free end of the support element 16 being pivotally moved towards the lower portion of the fixing base 14. In other words, the restoring force provided by the elastic element 13 is adapted to support the limiting element 17, wherein the second catch element 19 is supported by the limiting element 17, so that the first catch element 1 is blocked by the second catch element 19. That is to say, the second catch element 19 is hooked on the first catch element 15. Preferably, the first catch element 15 is a fixing plate 71, and the second catch element 19 is a baffle 72. In other words, the baffle 72 is biased against the fixing plate 71 to overcome the torsion exerted on the support element 16 provided by the elastic element 13, so as to maintain the support element 16 in the first position.

2. Remove the second catch element 19, and the second catch element 19 is not stopped by the first catch element 15 of the support element 16. An external force is exerted to the limiting element 17 to overcome the torsion exerted on the limiting element 17 by the elastic resetting element 43, so as to drive the first catch element 15 being un-blocked by the second catch element 19, wherein the guiding shafts 81 of the limiting element 17 is driven to move towards the guiding grooves 81, so that the triggering element 18 is guided to move away from the first catch element 15, and then the second catch element 19 is detached from the first catch element 15. It is worth mentioning that the external force is exerted on the triggering element 18, so that the limiting element 17 is able to overcome the torsion provided by the elastic resetting element 43. The triggering element 18 is activated to move the limiting element 17, and the first catch element 15 of the limiting element 17 is moved to un-blocked by the second catch element 19, so as to release the first catch element 15.

3. Pivotally move the support element 16, and the free end of the support element 16 is pivotally moved towards the lower portion of the fixing base 14. According to the preferred embodiment of the present invention, the automatic installation lamp 1 is supported by the ceiling 500. While the second catch element 19 is moved to detach from the first catch element 15, the free end of the support element 16 is pivotally moved towards the lower portion of the fixing base 14 by the restoring force provided by the elastic element 13. While the free end of the support element 16 is touched with the ceiling 500, the resetting force provided by the elastic element 13 is adapted to force the free end of the support element 16 to support the fixing base 14, and until the protruded edge of the fixing base 14 is touched with the installation hole 501. The automatic installation lamp 1 can be fixed on the installation hole 501. The automatic installation lamp 1 is installed completely.

4. Lift up the fixing base 14, and force the lower portion of the fixing base 14 being touched with the ceiling 500, so as to fix the automatic installation lamp 1 on the ceiling 500. The free end of the support element 16 is blocked for rotating towards the lower portion of the fixing base 14 as well as that the support element 16 being touched with the ceiling 500. The restoring force provided by the elastic element 13 is exerted on the free end of the support element 16 to rise up the fixing base 14. The automatic installation lamp 1 is fixed on the ceiling 500, and the fixing base 14 of the automatic installation lamp 1 is raised up to abut the ceiling 500, so as to fix the automatic installation lamp 1 on the ceiling. While the free end of the support element 16 is contacted with the ceiling 500, the restoring force provided by the elastic element 13 is adapted to raise up the fixing base 14 until the protruded edge of the fixing base 14 is touched with the installation hole 501. Therefore, the automatic installation lamp 1 is fixed into the installation hole 501. And, the automatic installation lamp 1 is installed completely.

It is worth mentioning that before the step 1 of the installation method for the automatic installation lamp 1, the installation method further comprises a step a: pivotally move the free end of the support element 16 to achieve the first position. The support element 16 is in the erect situation. The external force is exerted on the support element 16 to force the free end of the support element 16 to overcome the restoring force provided by the elastic element 13, so as to force the free end of the support element 16 being pivotally moved towards the upper portion of the fixing base 14. The first catch element 15 arranged on the support element 16 is biased against the second catch element 15 to reach the first position, wherein while the first catch element 15 is touched with the second catch element 19, the second catch element 19 is endured by a pressure provided by the first catch element 15, so that the second catch element 19 is moved to a position that the second catch element 19 cannot be locked by the first catch element 15. The second catch element 19 is adapted to overcome the restoring force provided by the elastic resetting element 43 to drive the guiding shaft 81 of the limiting element 17 being moved towards the guiding groove 81. While the first catch element 15 is biased against the second catch element 19, the restoring force provided by the elastic resetting element 43 is adapted to force the first catch element 15 being locked by the second catch element 19.

It is worth mentioning that the installation method for the automatic installation lamp 1 further comprises a step 5 after the step 4: Remove the second catch element 19, and the restoring force provided by the elastic resetting element 43 is exerted on the triggering element 18 to force the triggering element 18 moving towards the guiding groove 80, so that the second catch element 19 return to be hooked on the first catch element 15.

Figure 21:
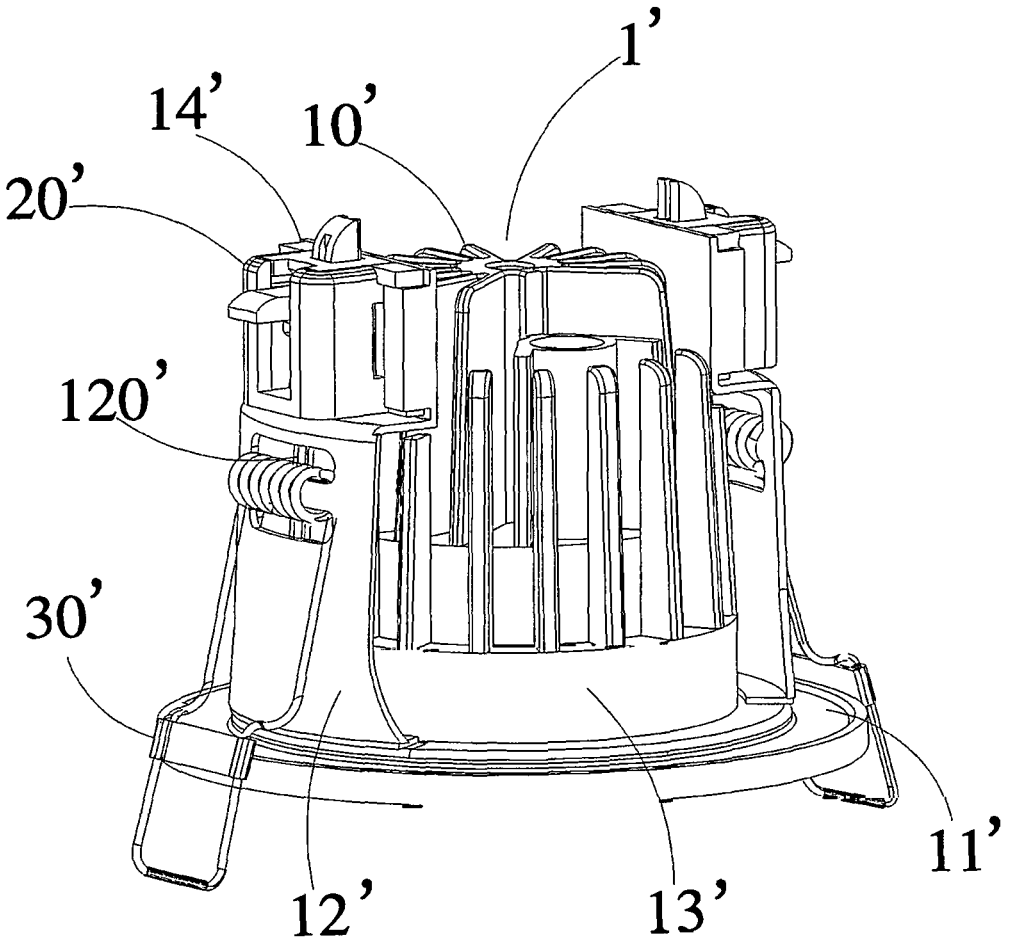
FIG. 21 is a perspective view of an automatic installation device for an automatic installation lamp according to a preferred embodiment of the present invention.
Figure 22A:
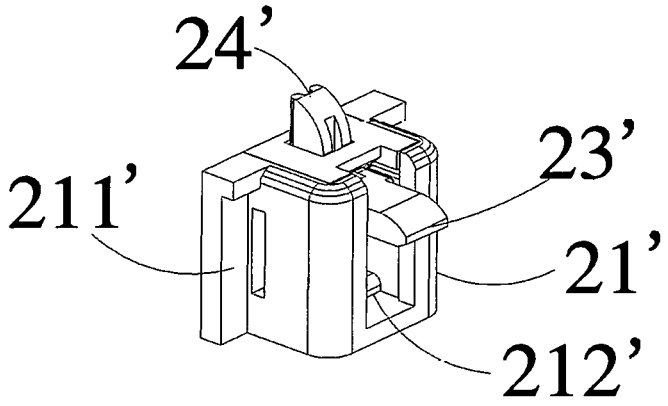
FIG. 22A is a perspective view of an automatic switch for an automatic installation device for an automatic installation lamp according to the above preferred embodiment of the present invention.
Figure 22B:
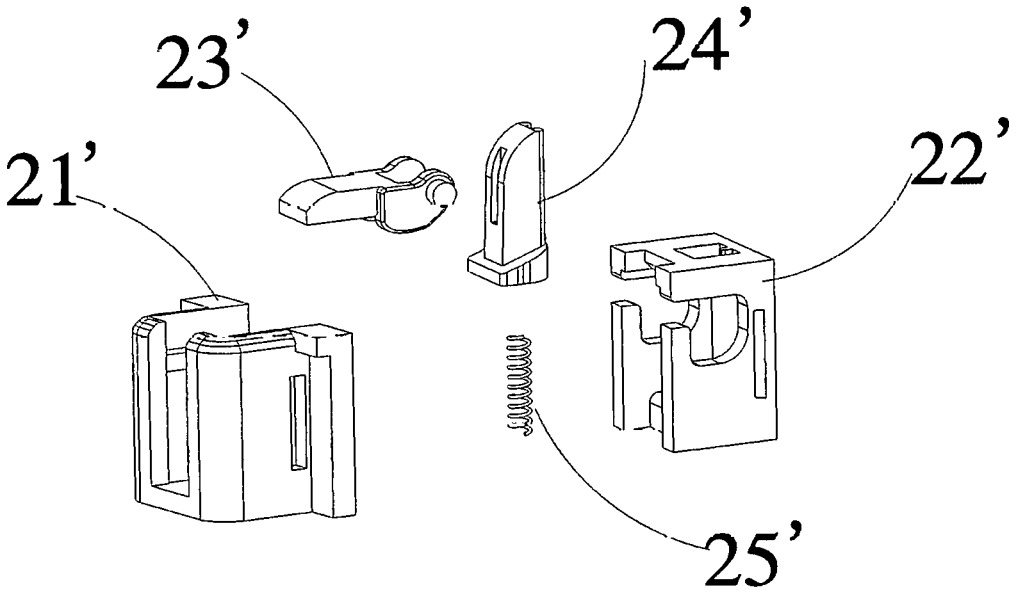
FIG. 22B is an exploded perspective view of an automatic switch for an automatic installation device for an automatic installation lamp according to the above preferred embodiment of the present invention.
Figure 23:
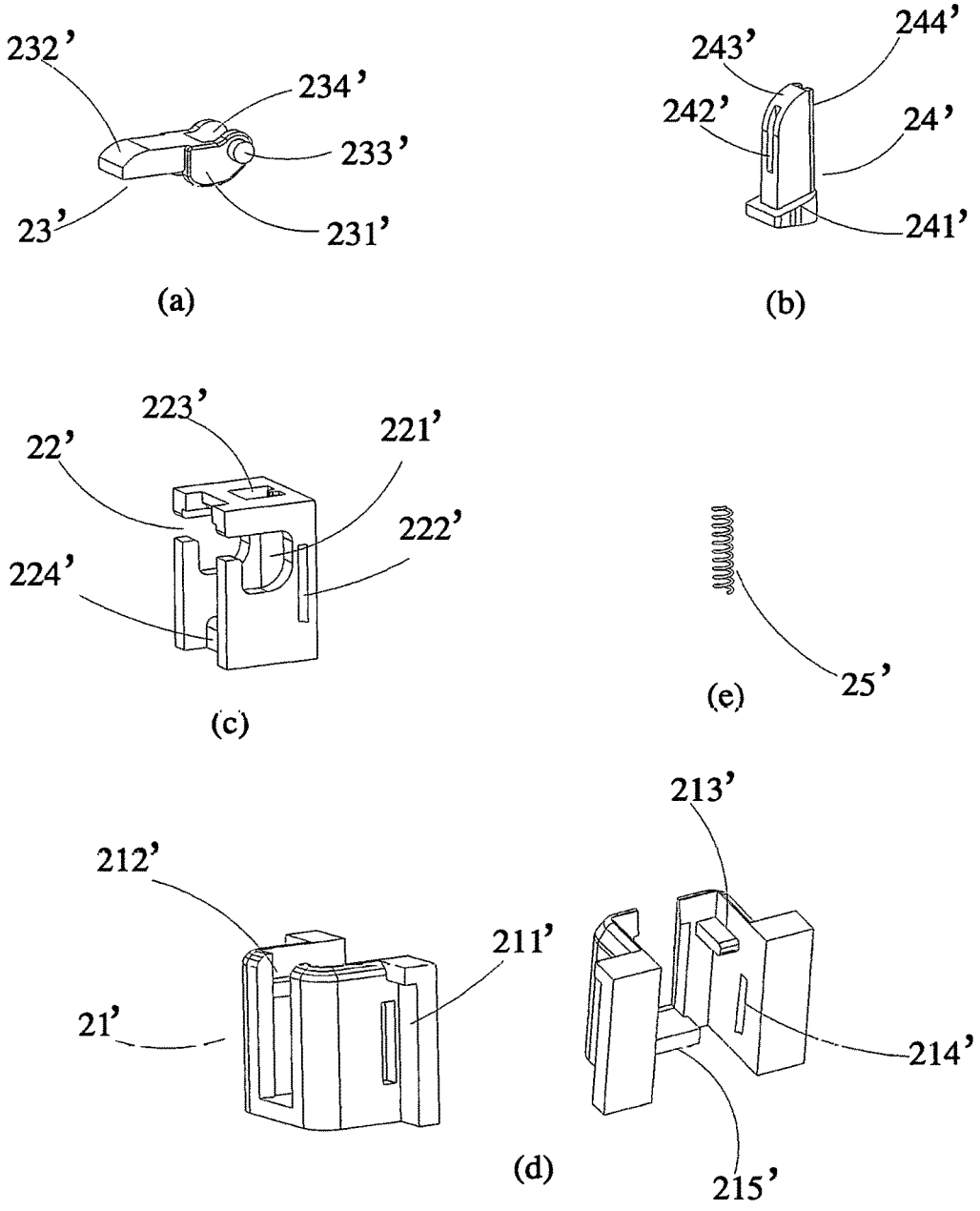
FIG. 23 is an exposed view of an automatic switch for an automatic installation device for an automatic installation lamp according to the above preferred embodiment of the present invention.
Figure 24:
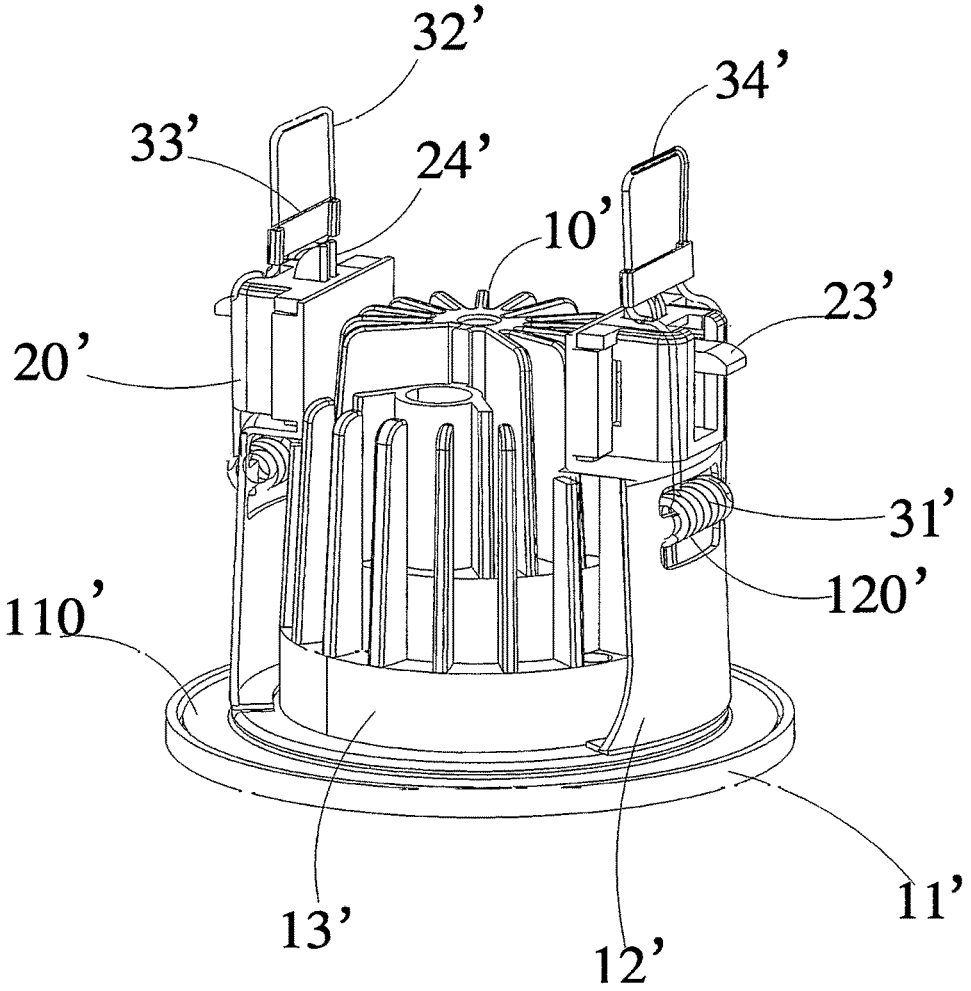
FIG. 24 is a perspective view of a lock unit for an automatic installation device for an automatic installation lamp according to the above preferred embodiment of the present invention.

Referring to FIG. 21 of the drawings, an automatic installation device for an automatic installation lamp' according to a preferred embodiment of the present invention is illustrated, wherein the automatic installation device comprises a shell body 10' for receiving the lamp, an automatic switch 20', and a lock unit 30'.

The shell body 10' comprises a flat and circle shaped base 11', two protruded fixing plate 12' symmetrically arranged, and a ring-shaped fixing wall 13' arranged between two fixing plate 12', wherein the base 11' has a circle and plate shaped, and an outer edge of the base 11' is slightly protruded, and the outer edge of the base 11' is inwardly and downwardly extended to from a base groove 110', so that the automatic installation lamp 1' can be used in different space and environment, and the automatic installation lamp 1' can be incorporated with other external components, so as to improve the flexibility of the use. The lower portion of the fixing plate 12' is closely connected with the ring-shaped fixing wall 13', and the upper portion of the fixing plate 12' is slightly incurvated, and two through hole 120' are parallelly arranged on a position close to the two fixing plates 12' respectively, wherein the through hole 120' is adapted to install the lock unit 30'. The shell body 10' further comprises a connection portion 14' adapted to install the automatic switch 20', wherein the connection portion 14' comprises an inwardly extended structure adapted to install the automatic switch 20'.

Referring to FIG. 22A, FIG. 22B, and FIG. 23 to FIG. 24, the automatic switch 20' comprises a cover 21', an operation cavity member 22', a trigger arm 23', a moving block 24' actuated by the trigger arm 23', and an elastic element 25', wherein outer two sides of the cover 21' are outwardly extended to form outer-side stations 211' adapted to support the automatic switch 20' being installed on the shell body 10', and the front end of the cover 21' comprises a cover opening 212'. It is noticed that the uppermost horizontal portions of the cover opening 212' are not connected with each other, so that the cover opening 212' is formed as a T-shaped, so as to provide a rotation space for the trigger arm 23'. Two sides of the rear and inner portion of the cover opening 212' comprises two horizontally extended inner-side stations 213' to limit the trigger arm 23' only being operated in a movable manner, i.e. rotatable manner, so as to prevent the trigger arm 23' being operated towards the front and back direction. The cover 21' further comprises a inner-side slot 214' obliquely and vertically formed on the inner-side station 213', wherein the inner-side slot 214' is adapted to incorporate with the operation cavity member 22'. The cover 21' further comprises a bottom boss 215' formed inside the cover opening 212'. It is worth mentioning that the cover 21' and the operation cavity member 22' are able to be incorporated with each other, and in such manner, the bottom boss 215' of the cover 21' will be connected with a bottom portion of the operation cavity member 22'. The operation cavity member 22' comprises two P-shaped grooves 221' formed on two inner side walls of the operation cavity member 22' to provide a operation space for the trigger arm 23'. The operation cavity member 22' further comprises two outer-side protruded portions 222' formed on the two outer side of the operation cavity member 22' and close to the P-shaped grooves 221', adapted to fixedly connect with the cover 21'. And, the upper portion of the operation cavity member 22' comprises an upper opening 223' adapted to lock the moving block 24' and an elastic element 25' adapted to support the moving block 24' moving back to its original position. The operation cavity member 22' further comprises a block element 224' adapted to place and support the elastic element 25', and the trigger arm 23' is placed on the uppermost portion of the operation cavity member 22'. The trigger arm 23' comprises an elliptic cam 231', an arc-shaped tension arm 232' frontwardly extended from the elliptic cam 231', and two cylindrical fixing components 233' formed on two sides of the elliptic cam 231', wherein the fixing components 233' are adapted to support the trigger arm 23' being installed into the operation cavity member 22'. In addition, the rear end of the elliptic cam 231' is a hollow structure, and the trigger arm 23' further comprises a guiding member 234' formed inside the hollow structure to control the moving block 24' moving within a particular space. The moving block 24 is formed between the arc-shaped tension arm 232', the fixing component 233', and the guiding member 234', wherein the moving block 24' is a long type structure, and the bottom two sides of the moving block 24' is defined as a resetting element 241' outwardly extended to from an inclined structure. The resetting element 241' is adapted to support the trigger element 23' to move back to its original position. The front end of the moving block 24' comprises a locating slot 242' inwardly extended from the moving block 24', wherein the locating slot 242' is adapted to incorporate with the guiding element 234' to support the moving block 24' operating within a suitable direction and space. The moving block 24' further comprises a supporting element 243' having an arc-shaped structure formed on the upper portion of the moving block 24', and a supporting slot 244', formed as a track, to support the moving block 24' operating only in an up-and-down direction. The elastic element 25' is formed under the moving block 24' and inside the operation cavity member 22', wherein the elastic element 25' is able to provide torsion to the trigger arm 23', so as to force the trigger arm 23' being moving back to its original position. Therefore, the elastic element 25' is a component which can provide certain amount of resetting force, so in the present invention, the elastic element 25' is a spring which is easy to obtain and having low in cost.

It is noticed that a top portion of the cover 21' is designed as an inclined structure, wherein the cover 21' is connected with the ceiling 50' during the installation procedure, so that the inclined structure can prevent the automatic switch 20' being locked by the installation hole 51' during the installation procedure.

Referring to FIG. 21 to FIG. 24, two lock unit 30' are arranged on two bottom sides, left side and right side, of the automatic switch 20', wherein the lock unit 30' comprises two elastic portions 31' at the fixing plates, a pair of supporting arm 32' extended from the elastic portions 31', two locking element 33', two fixing portions 34', and two bending portions 35' formed at the supporting arms 32', wherein the lock unit 30' is made of elastic metal, and the elastic portion 31' has the same function as the spring adapted to support the automatic switch 20' being operated during installation procedure and being returned back to its original situation. In other words, the elastic portions 31' will apply elastic forces to the supporting arms 32' to fold the supporting arms 32' downwardly. The supporting arms 32' are parallelly extended from two ends of the elastic portion 31', wherein the supporting arm 32' not only is adapted to support the automatic installation lamp 1' being installed on the installation hole 51', but also able to improve the strength and stability of the installation, wherein one end of the lock unit 30' is fixed on the base 11', and the other end of the lock unit 30' is a movable manner, so the supporting arm 32' is used to be determined the amount of action force provide on the lock unit 30'. Therefore, the lock unit 30' can be made of variable elastic steels having better hardness and resetting capacity. In addition, the two supporting arms 32' have the larger strength and durability while the two supporting arms 32 are parallelly arranged. In order to facilitate the inspection and maintainability, the locking element 33' is arranged between two parallel arm portions of each of the supporting arms 32'. While the length of the supporting arm 32' is reduced to a certain distance, the rear end of the supporting arm 32' can be form as a locker, so as to maintain the two arm portions of the supporting arm 32' being parallelly arranged and ensure the safety use of the present invention. Besides, the locking element 33' is arranged at a position that the locking element 33' is located above the bending portion 35' and can lock with the moving block 24' while the moving block 24' is upwardly protruded to contact with the locking element 33', wherein the locking element 33' is used to pull up on a particular position which can be determined as an anticipation position before the installation procedure, so as to improve the efficiency and the yield rate of the installation procedure. In order to make sure that the structure of the lock unit 30' will not be affected by the external force or objects, after the two supporting arms 32' are outwardly extended to a predetermined distance, the U-shaped fixing portion 34' is provided to make the lock unit 30' to form a close structure, so that the lock unit 30' is in a stable structure.

In order to ensure the structure and the stability of the present invention by incorporating the physical structure and mechanics principle thereof, the bending portion 35' is a labor-saving structure, and the inwardly extended bending portion 35' is able to reduce the distance between the locking element 33' and the moving block 24', and the distance of the application of a force is reduced, so that the time and strength of the application of the force is relatively reduced, and the total energy-consuming of the lock unit 30' is reduced also, so as to achieve the labor-saving purpose. The bending portion 35' is an auxiliary device, wherein since the automatic installation lamp 1' is in mass production, the specifications and styles of the bending portion 35' are fixed.

Since the automatic installation lamp 1 can be installed in different size of installation hole 51', but the thickness of the different kinds of installation holes 51' are always different. Although, the thickness of the installation hole 51' will not affect the successful rates and the stability of the installation procedure, the ceiling 50' having a hardness depth needs to consume more energy during the installation procedure, or other unobvious effects may affect the installation procedure. Therefore, the bending portion 35' is able to ensure the rear end of the lock unit 30' being close to the circumference of the shell body 10', and the lock unit 30' can be remained in an anticipation position before installation procedure, so as to ensure the operation rate and successful rate of the installation procedure. The bending portion 35' also can be determined as a reinforcement structure. Although, the outside of the installation hole 51' look like the same, but most of people don't know the installation situation inside the installation hole 51'. The housing structure or other reasons may affect the installation condition of the installation hole 51', so that the successful rate of the installation procedure may be affected. Therefore, the bending portion 35' provides an adjustable and elastic space for the lock unit 30', so that the successful rate of the installation procedure will not be affected by other external facts, so as to improve the installation stability of the installation procedure.

Figure 25:
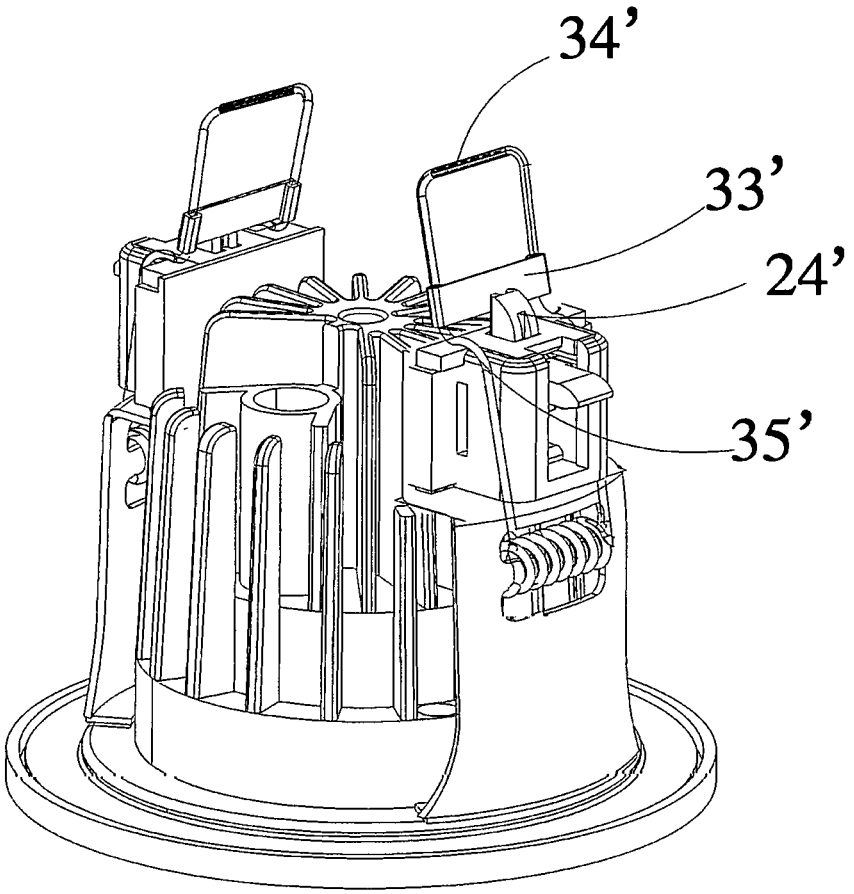
FIG. 25 is a perspective view of a lock unit for an automatic installation device for an automatic installation lamp according to the above preferred embodiment of the present invention, illustrating that the moving block is locked on the locking portion.

As shown in FIG. 25, it is worth mentioning that before the installation method of the automatic installation device, the two bending portions 35' are pulled upwardly, and the locking element 33' of the lock unit 30' is locked by the moving block 24' of the automatic switch 20' in a fixed position.

Figure 26:
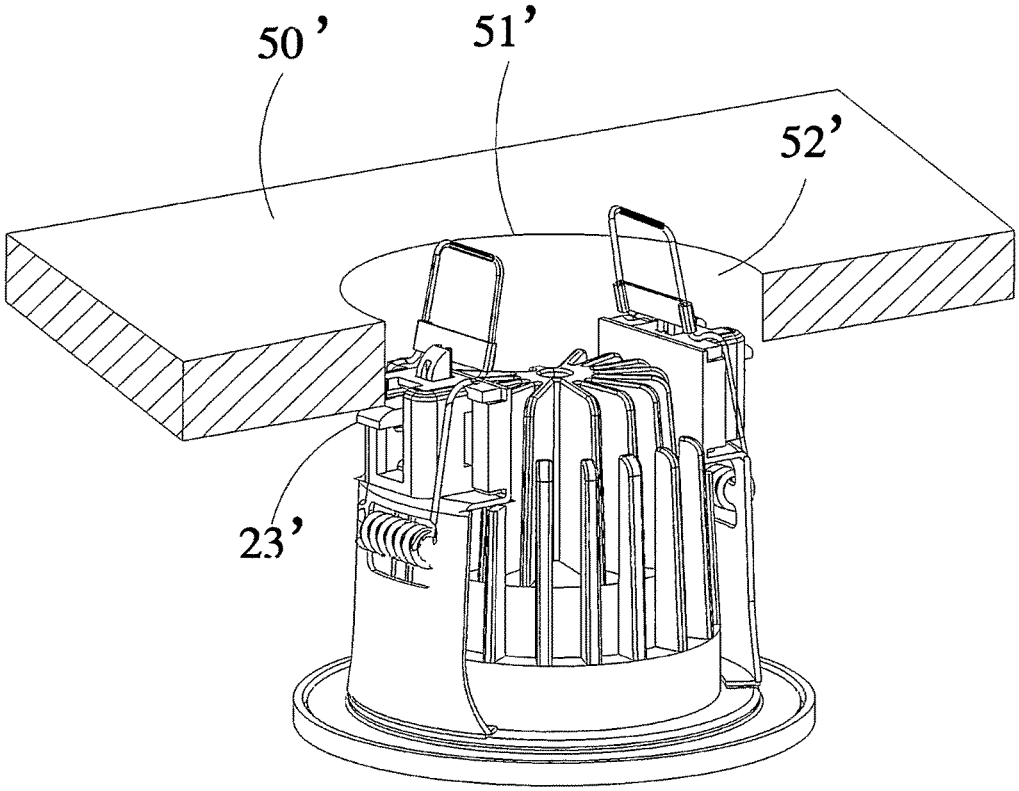
FIG. 26 is a perspective view of an automatic installation device for an automatic installation lamp according to the above preferred embodiment of the present invention, illustrating that the automatic installation lamp is mounted on the ceiling.

As shown in FIG. 26, after the locking element 33' of the lock unit 30' is locked by the moving block 24' of the automatic switch 20', the automatic installation lamp 1' is faced towards the installation hole 51' of the ceiling 50', and in such manner that the two automatic switch 20' must be installed on a corresponding position, so the straight line distance between the two automatic switch 20' is determined as a circle diameter of the automatic installation lamp 1'. The outer edge of the automatic switch 20' is adapted to biased against the inner circumferential rim of the installation hole 51', and the automatic installation lamp 1' is pushed upwardly to actuate the trigger arm 23', so as to activation the operation of the installation procedure. The operation procedure of the automatic switch 20' is shown in FIG. 26. At first, while the trigger arms 23' are not operated, the trigger arms 23' are arranged horizontally with respect to the moving block 24', and the trigger arms 23' are arranged at a position where is protruded with respect the cover opening 211' of the cover 21', so that the trigger arms 23 are also arranged horizontally with respect the cover opening 211'. In addition, the moving block 24' is also protruded with respect to the upper opening 223' of the operation cavity member 22', and the moving block 24' is horizontal to the upper opening 223'. Therefore, while the automatic installation lamp 1 is pushed into the installation hole 51', the trigger arms 23' are biased against an inner wall 52' of the installation hole 51', so that an arc-shaped tension arm 232' of the trigger arm 23' is downwardly operated by the anti-reaction force provided by the inner wall 52' of the installation hole 51', and then the elliptic cam 231' of the trigger arms 23' is operated in an opposite direction with respect to the arc-shaped tension arm 232', so that the moving block 24' is activated to operate downwardly and is dis-meshed with the lock unit 30', and finally the lock unit 30' will reset to its original position. In other words, the supporting arms 32 will press on the ceiling.

Figure 27:
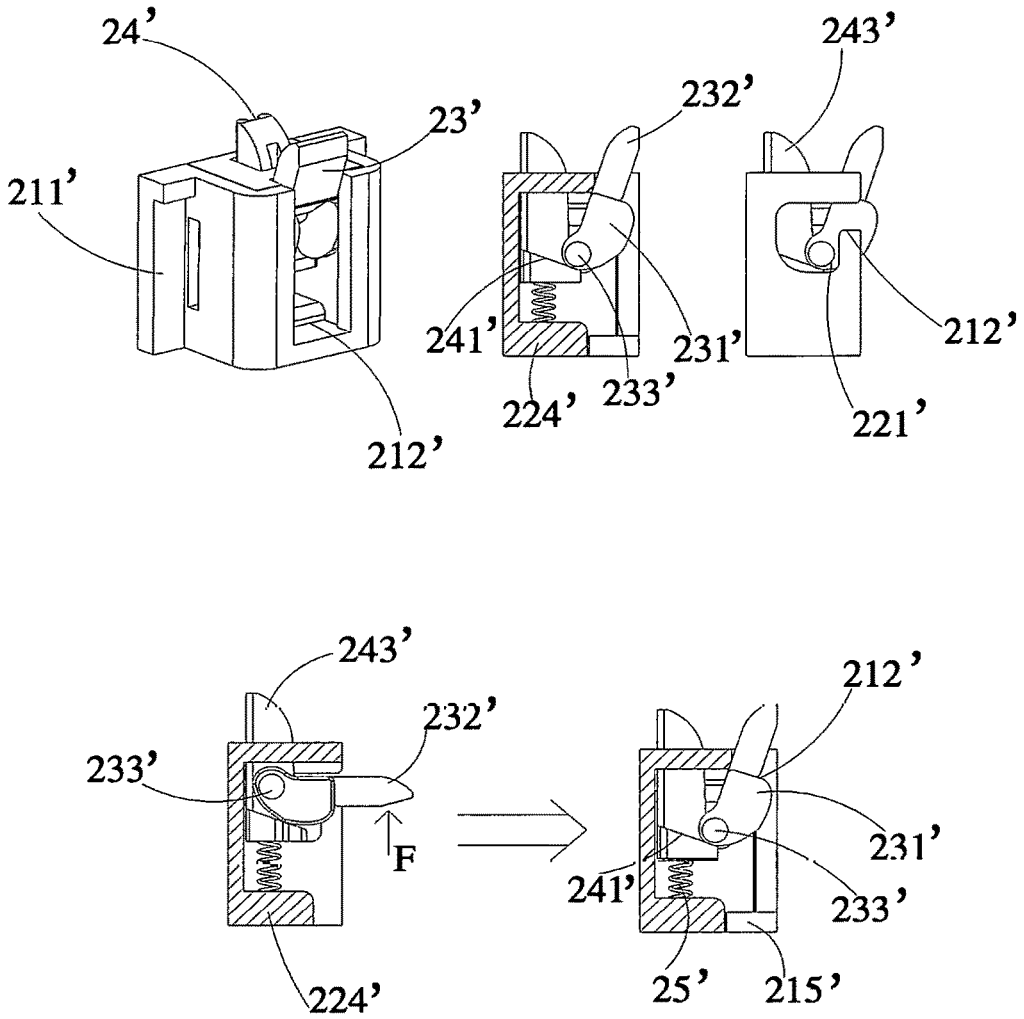
FIG. 27 is a perspective view of an automatic switch of an automatic installation device for an automatic installation lamp according to the above preferred embodiment of the present invention, illustrating that an operation of the automatic switch while the automatic installation lamp is detaching from the ceiling.

Referring to FIG. 27 of the drawings, while the shell body 10' of the automatic installation lamp 1 is detaching from the ceiling 50', the automatic installation lamp 1' is pulled down by an external force, so as to destroy the original dynamic equilibrium. While the shell body 10' is continuously pulled down, the supporting arms 32 only can move downwardly due to that the lock unit 30' is moved downwardly. While the shell body 10' of the automatic installation lamp 1' is continuously moved down, the automatic switch 20' is exposed, and the outer wall of the cover 21' is not blocked by the inner wall of the installation hole 52', so that the trigger arms 23' can be outwardly extended to return to its original situation. In addition, the elliptic cam 231' is activated to rotate to drive the movement of the moving block 24'. In such manner, the elastic element 25' is compressed and then released to provide torsion to force the moving block 24' being moved upwardly. The lock unit 30' is moved to pass through the installation hole 51' while the automatic installation lamp 1' is continuously moved upwardly. Furthermore, the bending portion 35' is an arc-shaped structure, so no angle will generate between the lock unit 30' and the installation hole 51'. Therefore, the automatic installation lamp 1' will not be locked within the installation hole 51' while the automatic installation lamp 1' is detaching from the installation hole 51'.

Figure 28:
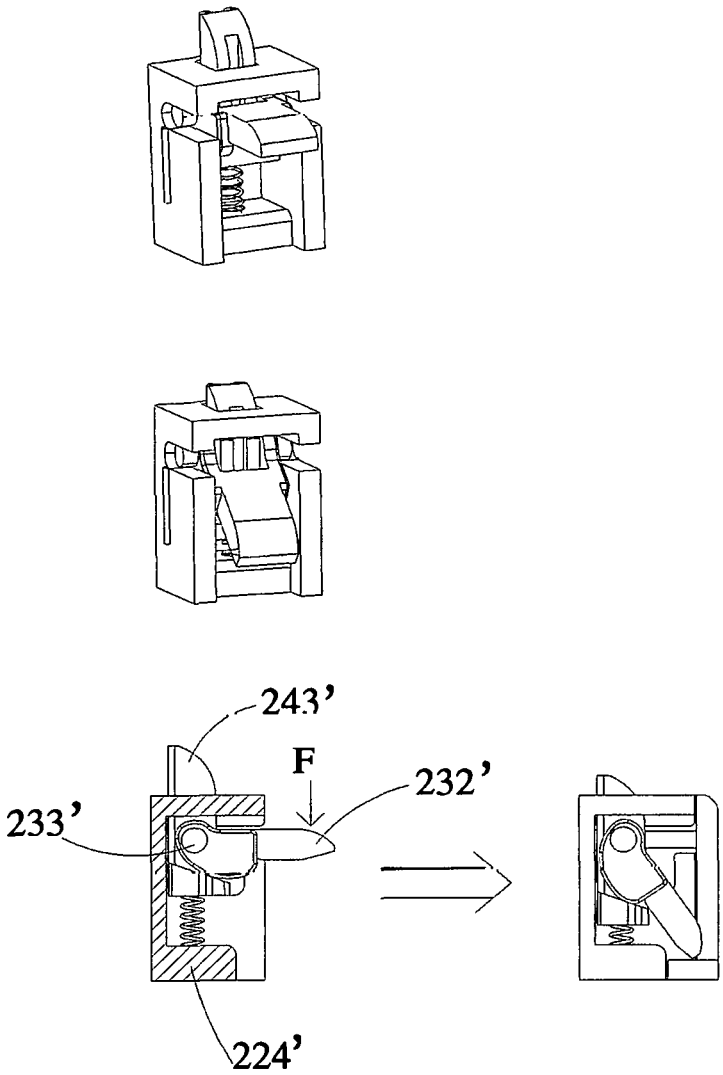
FIG. 28 is a perspective view of an automatic switch of an automatic installation device for an automatic installation lamp according to the above preferred embodiment of the present invention, illustrating that an operation of the automatic switch while the automatic installation lamp is mounted on the ceiling.

Referring to FIG. 28 of the drawings, while the supporting arms 32' of the lock unit 30' is operated to return to its original position, the installation hole 52' of the ceiling 50' only can allow the shell body 10' being passed through, the supporting arms 32' can not pass through the installation hole 51' due to the length thereof, and the size of the base 11' is also larger than the installation hole 51', so that a downward resetting force provided by the lock unit 30' is exerted on the automatic installation lamp 1', and then an anti-resetting force will generate on the base 11', wherein the resetting force and the anti-resetting force have the same amount with opposite direction, and the dynamic equilibrium will generate on the automatic installation lamp 1' due to the Newton's third law of motion, so that the automatic installation lamp 1' is fixed on the ceiling 50'

One skilled the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An automatic installation device for installing a lamp into an installation hole of a ceiling, comprising:

a shell body for receiving the lamp, wherein said shell body comprises a flat and circle shaped base and two protruded fixing plates spacedly extended upwardly from said base;

a lock unit which comprises two elastic portions coupled at said fixing plates respectively, two supporting arms extended from said elastic elements respectively, and two locking elements provided at said supporting arms respectively, wherein said elastic portions apply elastic forces to said supporting arms to fold said supporting arms downwardly, wherein each of said supporting arms has a bending portion; and an automatic switch which comprises two covers supported at said shell body, two trigger arms movably supported at said covers respectively, two moving blocks actuated by said trigger arms respectively, and two elastic elements supported under said moving blocks respectively, wherein said moving blocks are engaged with said locking elements to retain said supporting arms at an upward manner for allow said shell body to pass through the installation hole of the ceiling, wherein when said trigger arms are actuated and downwardly moved via an inner wall of the installation hole, said moving blocks are actuated to disengage with said locking element, such that said supporting arms are downwardly folded by said elastic portions for pressing on the ceiling.

2. The automatic installation device, as recited in claim 1, wherein said shell body further comprises a ring-shaped fixing wall arranged between said two fixing plates for supporting the lamp being securely affixed on the ceiling.

3. The automatic installation device, as recited in claim 1, wherein each of said covers has a T-shaped cover opening formed at a front end of said cover to allow said trigger arm operated therein.

4. The automatic installation device, as recited in claim 3, wherein each of said covers comprises an outer-side station outwardly extended from a rear side of said cover to support said automatic switch being mounted on said base.

5. The automatic installation device, as recited in claim 3, wherein each of said covers comprises an inner-side station formed on an inner side wall of said cover to limit a moving range of said trigger arm.

6. The automatic installation device, as recited in claim 5, wherein said automatic switch further comprises an operation cavity member, wherein said cover comprises an inner side slot formed below said inner-side station adapted to incorporate with said operation cavity member.

7. The automatic installation device, as recited in claim 6, wherein said operation cavity member, having a hollow structure, comprises an upper opening to allow said moving block passing therethrough.

8. The automatic installation device, as recited in claim 7, wherein said operation cavity member comprises an outer-side protruded portion formed on two outer side walls of said operation cavity member to incorporate with said cover.

9. The automatic installation device, as recited in claim 7, wherein said operation cavity member has a P-shaped groove formed the uppermost portion of two outer side walls of said operation cavity member to provide a rotation space for said trigger arm.

10. The automatic installation device, as recited in claim 1, wherein said trigger arm comprises a cam that controls a movement of said moving block.

11. The automatic installation device, as recited in claim 10, wherein said trigger arm comprises two fixing components outwardly extended from two sides of said cam and engaged with said P-shaped grooves of said operation cavity member to support said trigger arm.

12. The automatic installation device, as recited in claim 10, wherein said trigger arm comprises an arc-shaped tension arm forwardly extended from said cam.

13. The automatic installation device, as recited in claim 1, wherein said trigger arm comprises a guiding component formed at a rear end of said trigger arm to control said moving block moving along a straight line.

14. The automatic installation device, as recited in claim 1, wherein said moving block has an elongated structure that a bottom side of said moving block is wider than a top side thereof, wherein a bottom side of said moving block has an arc-shaped end to reduce a friction generated thereat.

15. The automatic installation device, as recited in claim 14, wherein the bottom side of said moving block is defined as a resetting element outwardly extended to from an inclined structure, so as to support said cam and said moving block moving back to their original positions.

16. The automatic installation device, as recited in claim 13, wherein a front end of said moving block has a locating slot inwardly extended from said moving block adapted to incorporate with said guiding element so as to support said moving block operating within a suitable direction and space.

17. The automatic installation device, as recited in claim 1, wherein said automatic switch further comprises an operation cavity member, wherein said elastic element is a compressed spring, and is formed under said moving block and inside said operation cavity member.

18. The automatic installation device, as recited in claim 1, wherein said lock units are made of elastic metal and have the resetting ability of said elastic resetting element.

19. The automatic installation device, as recited in claim 1, wherein said supporting arms are located behind said moving block due to a bending angle of said bending portion.

20. The automatic installation device, as recited in claim 1, wherein said two supporting arms are outwardly extended to a predetermined distance, wherein said locking unit further comprises two U-shaped fixing portions extended from said supporting arms to ensure said lock unit to form a close structure.

* * * * *